US009768526B2

(12) United States Patent
Kawamura et al.

(10) Patent No.: US 9,768,526 B2
(45) Date of Patent: Sep. 19, 2017

(54) CRIMP-CONNECTION STRUCTURAL BODY, WIRE HARNESS, METHOD OF MANUFACTURING CRIMP-CONNECTION STRUCTURAL BODY, AND DEVICE OF MANUFACTURING CRIMP-CONNECTION STRUCTURAL BODY

(71) Applicants: FURUKAWA ELECTRIC CO., LTD., Tokyo (JP); FURUKAWA AUTOMOTIVE SYSTEMS INC., Inukami-gun (JP); TOYOTA JIDOSHA KABUSHIKI KAISHA, Toyota-shi (JP)

(72) Inventors: Yukihiro Kawamura, Inukami-gun (JP); Takashi Tonoike, Inukami-gun (JP); Takahito Nakashima, Toyota (JP); Hiroshi Kobayashi, Toyota (JP); Hiroyasu Taga, Toyota (JP)

(73) Assignees: FURUKAWA ELECTRIC CO., LTD., Tokyo (JP); FURUKAWA AUTOMOTIVE SYSTEMS INC., Inukami-gun (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/029,044

(22) PCT Filed: Oct. 14, 2014

(86) PCT No.: PCT/JP2014/077347
§ 371 (c)(1),
(2) Date: Apr. 13, 2016

(87) PCT Pub. No.: WO2015/056672
PCT Pub. Date: Apr. 23, 2015

(65) Prior Publication Data

US 2016/0240938 A1 Aug. 18, 2016

(30) Foreign Application Priority Data

Oct. 15, 2013 (JP) ..... 2013-214331
Dec. 28, 2013 (JP) ..... 2013-273649

(51) Int. Cl.
*H01R 4/10* (2006.01)
*H01R 4/20* (2006.01)
(Continued)

(52) U.S. Cl.
CPC ..... *H01R 4/203* (2013.01); *H01R 4/188* (2013.01); *H01R 4/62* (2013.01); *H01R 43/048* (2013.01); *H01R 4/206* (2013.01)

(58) Field of Classification Search
CPC ..... H01R 4/203; H01R 4/62; H01R 4/188; H01R 4/206; H01R 4/20; H01R 43/048
(Continued)

(56) References Cited

U.S. PATENT DOCUMENTS 7,252,564 B1 * 8/2007 Morello ..... H01R 4/185 439/843
2004/0168315 A1 * 9/2004 Onuma
2014/0144011 A1 5/2014 Sugimoto et al.

FOREIGN PATENT DOCUMENTS

CN 101752771 A * 6/2010
CN 103503249 A 1/2014
(Continued)

OTHER PUBLICATIONS

Combined Office Action and Search Report issued Apr. 5, 2017 in Chinese Patent Application No. 201480050806.X (with English translation).*
(Continued)

*Primary Examiner* — Javaid Nasri
(74) *Attorney, Agent, or Firm* — Oblon, McClelland, Maier & Neustadt, L.L.P.

(57) ABSTRACT

A crimp-connection structural body, a wire harness, a method of manufacturing a crimp-connection structural body, and a manufacturing device are provided. The crimp-connection structural body includes an insulated wire formed by covering a conductor by an insulating cover, and a crimp terminal having a crimp section allowing connection by crimp of a conductor exposed portion formed by exposing the conductor. The crimp section is formed of a closed-barrel-type crimp section, and a cross-sectional shape of the crimp section in a radial direction is formed into an approximately recessed cross-sectional shape having a crimp recessed portion formed by indenting by inclined portions inclined from positions spaced-apart from each other by a predetermined distance. The predetermined distance is set to 90% or less of an entire width of the crimp section. An opposedly facing angle made by the inclined portions is set to a value which ranges from 10° to 120° inclusive.

18 Claims, 15 Drawing Sheets

(51) Int. Cl.
*H01R 4/18* (2006.01)
*H01R 4/62* (2006.01)
*H01R 43/048* (2006.01)

(58) Field of Classification Search
USPC ..... 439/877
See application file for complete search history.

(56) References Cited

FOREIGN PATENT DOCUMENTS

| | | | |
|---|---|---|---|
| EP | 2 738 885 | A1 | 6/2014 |
| JP | 54-14386 | | 1/1979 |
| JP | 2004-71437 | A | 3/2004 |
| JP | 2009-87848 | A | 4/2009 |
| JP | 2011-243467 | A | 12/2011 |
| JP | 2013-30274 | A | 2/2013 |
| KR | 10-2013-0137699 | A | 12/2013 |

OTHER PUBLICATIONS

International Search Report Issued Dec. 9, 2014 in PCT/JP14/077347 Filed Oct. 14, 2014.
Written Opinion issued Dec. 9, 2014 in PCT/JP2014/077347 (with English Translation).
Korean Office Action issued Dec. 16, 2016 in Patent Application No. 10-2016-7005769 (with English Translation).
Japanese Office Action issued Aug. 2, 2016 in Patent Application No. 2015-542614 (with English Translation).
Office Action issued Nov. 1, 2016 in Japanese Patent Application No. 2015-542614 (with English language translation).
Office Action issued Jun. 27, 2017 in Korean Patent Application No. 10-2016-7005769 with English Translation.

* cited by examiner

CRIMP-CONNECTION STRUCTURAL BODY, WIRE HARNESS, METHOD OF MANUFACTURING CRIMP-CONNECTION STRUCTURAL BODY, AND DEVICE OF MANUFACTURING CRIMP-CONNECTION STRUCTURAL BODY

TECHNICAL FIELD

The present invention relates to a crimp-connection structural body mounted on a connector or the like of an automobile wire harness, for example, a wire harness, a method of manufacturing a crimp-connection structural body, and a device of manufacturing a crimp-connection structural body.

BACKGROUND ART

An electric component mounted on an automobile or the like is connected to another electric component or a power source device through a wire harness which is formed by binding insulated wires thus forming an electric circuit. In this case, the wire harness, the electric component and the power source device are connected to each other by making connectors mounted on these parts respectively engage with each other by a male-female fitting engagement. A crimp-connection structural body where insulated wires and a crimp terminal are connected to each other is mounted on the connector.

The crimp terminal of the crimp-connection structural body is roughly classified into two types depending on a configuration of a crimp section which pressure-bonds the insulated wires. This will be described in more detail. The crimp terminal is classified into an open-barrel-type crimp terminal where a crimp section having one open end is formed into an approximately U shape in vertical cross section and a closed-barrel-type crimp terminal where a crimp section is formed into an approximately cylindrical shape.

In these two types of crimp terminals, the open-barrel-type crimp terminal is configured such that, for example, a portion of the crimp section on which a conductor exposed from an insulating cover is placed and which projects from the insulated wires is folded inward, and a distal end of the folded portion is inserted into the conductor thus crimp the conductor. With such a configuration, in the crimp-connection structural body which uses the open-barrel-type crimp terminal, conductivity is ensured by increasing a contact area between the conductor of the insulated wires and the crimp section of the crimp terminal.

On the other hand, with respect to the closed-barrel-type crimp terminal, for example, as in the case of a conductor connecting method described in Patent Document 1, a conductor of insulated wires is inserted into a connecting pipe portion of a crimp terminal which mounts a compression-use collar on an outer peripheral surface thereof and, thereafter, the compression-use collar is caulked into a hexagonal cross-sectional shape by a pair of dies thus crimp the conductor. With such a configuration, in the crimp-connection structural body which uses the closed-barrel-type crimp section, it is considered that the conductor can be pressure-bonded by the connecting pipe portion having a narrowed diameter while maintaining the shape of an inner peripheral surface which is a circular cross-sectional shape.

Further, in another crimp-connection structural body which uses a closed-barrel-type crimp terminal 50, as shown in FIG. 15 which shows a cross section in a width direction of a conductor crimp section 51 of the conventional crimp-connection structural body, the conductor crimp section 51 having an approximately cylindrical shape is plastically deformed in a diameter narrowing direction, and a crimp recessed portion 52 having an arbitrary shape is formed on the conductor crimp section 51 toward the center in a radial direction thus connecting the conductor crimp section 51 and a conductor 60 to each other by crimp.

Further, in the conductor crimp section 51 shown in FIG. 15, due to the formation of the crimp recessed portion 52 in addition to plastic deformation in the diameter narrowing direction, projecting portions 53 which project outward in the radial direction are formed adjacently to the crimp recessed portion 52. In this specification, the width-direction cross section indicates a cross section in the width direction Y approximately orthogonal to a long length direction of the conductor crimp section 51.

In another such crimp-connection structural body, the conductor 60 is strongly pressure-bonded by the crimp recessed portion 52, and a contact length of a contact portion between an inner peripheral surface of the conductor crimp section 51 and an outer peripheral surface of the conductor 60 is elongated in cross section in the width direction Y thus ensuring conductivity.

On the other hand, in another such crimp-connection structural body, at the time of crimp the conductor crimp section 51 and the conductor 60 to each other, there may be a case where assembling property is lowered or a case where irregularity occurs in a crimp shape depending on the shape of an inner surface of a crimp die.

For example, in the case where crimp of the conductor 60 and separation of a carrier and the crimp terminals 50 by cutting are performed by vertically caulking a plurality of crimp terminals 50 connected to an approximately strip-shaped carrier using one set of crimp dies, depending on a depth of an inner surface of the die positioned on a lower side, it is necessary to prepare a step of placing the conductor crimp section 51 of the crimp terminal 50. Alternatively, for example, in the case where the crimp terminals 50 are pressure-bonded by one set of crimp dies, there is a possibility that projecting portions 53 are not plastically deformed in conformity with the shape of an inner surface of the crimp die and hence, irregularity occurs in shape of the projecting portions 53.

Further, an entire width W1 which is a length in an approximately horizontal direction of the conductor crimp section 51 in a crimp state and a crimp height H1 which is a length in an approximately vertical direction of the conductor crimp section 51 in a crimp state are limited by, for example, a size and a shape of a cavity formed in a connector on which the crimp terminal is mounted, a shape of a crimp tool, a mechanical strength between the conductor crimp section 51 and the conductor 60.

Accordingly, although the shape of an outer surface of the conductor crimp section 51 in a crimp state is restricted in a width-direction cross section, the conductor crimp section 51 is plastically deformed without receiving any restriction with respect to the shape of an inner surface and a wall thickness of the conductor crimp section 51. As a result, in the conventional crimp-connection structural body, as shown in FIG. 15, there has been a case where a gap or the like is formed between an inner peripheral surface of the projecting portion 53 and an outer peripheral surface of the conductor 60.

That is, provided that the crimp recessed portion 52 has an arbitrary shape, the shape of an inner surface and the wall thickness of the projecting portion 53 cannot be controlled.

Accordingly, the crimp-connection structural body has a drawback that a contact length of a contact portion between an inner peripheral surface of the conductor crimp section 51 and an outer peripheral surface of the conductor 60 becomes unstable.

PRIOR ART DOCUMENT

Patent Document

Patent Document 1: Japanese Laid-Open Patent Publication No. 2011-243467

SUMMARY OF THE INVENTION

Problems to be Solved by the Invention

The present invention has been made in view of the above-mentioned drawbacks, and it is an object of the present invention to provide a crimp-connection structural body, a wire harness, a method of manufacturing a crimp-connection structural body, and a device of manufacturing a crimp-connection structural body which can ensure stable conductivity by controlling a cross-sectional shape of a crimp section in a crimp state.

Solutions to the Problems

The present invention is directed to a crimp-connection structural body which includes: an insulated wire formed by covering a conductive conductor by an insulating cover having insulation property; and a crimp terminal having a crimp section which allows connection by crimp of a conductor exposed portion formed by exposing the conductor by removing at least a portion of the insulating cover in a vicinity of a distal end of the insulating cover to the crimp section, wherein the conductor exposed portion is connected to the crimp section by crimp the conductor exposed portion by the crimp section, wherein the crimp section is formed of an approximately cylindrical closed-barrel-type crimp section which allows insertion of at least the conductor exposed portion thereinto and extends in a long length direction of the insulated wire, in a crimp state, a cross-sectional shape of the crimp section in a radial direction is formed into an approximately recessed cross-sectional shape having a crimp recessed portion formed by indenting by two inclined portions inclined inward from positions spaced-apart from each other by a predetermined distance in an approximately horizontal direction, the predetermined distance is set to 90% or less of an entire width of the crimp section in the approximately horizontal direction, and an opposedly facing angle made by the inclined portions which opposedly face each other in the radial direction is set to a value which ranges from 10° to 120° inclusive.

The above-mentioned conductor may be, for example, made of an aluminum-based material such as aluminum or an aluminum alloy, or a copper-based material such as copper or a copper alloy.

The above-mentioned crimp terminal may be, for example, made of a copper-based material such as copper or a copper alloy, or an aluminum-based material such as aluminum or an aluminum alloy.

The above-mentioned crimp recessed portion may be, for example, formed into an inverted trapezoidal shape, a W shape, a V shape or a U shape formed by inclined portions having the same inclination angle with respect to a center axis in an approximately vertical direction which passes the center of the crimp section in a radial direction, a shape formed by inclined portions having different inclination angles with respect to the center axis in an approximately vertical direction which passes the center of the crimp section in a radial direction or the like.

According to the present invention, stable conductivity can be ensured by controlling a cross-sectional shape of the crimp section in a crimp state.

This will be described more specifically. In the crimp-connection structural body, at the time of crimp the crimp section and the conductor exposed portion to each other, by forming the crimp recessed portion, it is possible to form projecting portions projecting outward in a radial direction on the crimp section adjacently to both ends of the crimp recessed portion.

At the time of forming the crimp section, by limiting the predetermined distance to 90% or less of an entire width of the crimp section, and also by limiting an opposedly facing angle made by the inclined portions which opposedly face each other in a radial direction to a value which ranges from 10° to 120° inclusive, in the crimp-connection structural body, it is possible to ensure widths of the projecting portions in an approximately horizontal direction at a predetermined rate with respect to the entire width of the crimp section. Accordingly, in the crimp-connection structural body, a shape of an inner surface and a wall thickness of the projecting portions can be easily controlled and hence, the electrical connection between the crimp section and the conductor exposed portion can be more stably ensured.

Further, by bringing a connection state immediately after the crimp into a more favorable state, for example, even when thermal expansion and thermal contraction are repeatedly generated in the crimp section or in the conductor exposed portion as in the case of a thermal shock test, in the crimp-connection structural body, the increase and irregularity in electric resistance caused by a change in the connection state can be suppressed. Accordingly, in the crimp-connection structural body, the stable electrical connection can be continuously ensured not only immediately after the crimp but also after the crimp.

In other words, when either one of a predetermined distance and an opposedly facing angle goes beyond the above-mentioned range, in the crimp-connection structural body, a shape of an inner surface which can stably ensure the electrical connection between the crimp section and the conductor exposed portion cannot be formed and hence, stable conductivity cannot be ensured.

This will be described in more detail. The smaller the rate that the predetermined distance accounts for with respect to the entire width of the crimp section, the wider a width of the projecting portion in an approximately horizontal direction becomes. Accordingly, although a change in wall thickness of the projecting portion of the crimp section brought about by the plastic deformation can be made small, an inner peripheral length of the crimp section in a radial cross section is liable to become long compared to an outer peripheral length of the conductor exposed portion in a radial cross section and hence, there is a possibility that a gap is formed between the crimp section and the conductor exposed portion.

On the other hand, the larger the rate that the predetermined distance accounts for with respect to the entire width of the crimp section, the narrower the width of the projecting portion in an approximately horizontal direction becomes. Accordingly, an inner space which allows the entrance of the conductor exposed portion therein due to crimp is minimally formed in the projecting portion. Further, when the rate that the predetermined distance accounts for with respect to the entire width of the crimp section is excessively large, the projecting portion which has an acute angle in cross section in a width direction and partially has a small wall thickness is formed and hence, there is a possibility that a crack occurs in the projecting portion.

Accordingly, when the rate that the predetermined distance accounts for with respect to the entire width of the crimp section goes beyond the predetermined range, in the crimp-connection structural body, a stable contact length cannot be ensured because of the formation of a gap between the crimp section and the conductor exposed portion.

In view of the above, it is desirable to limit the predetermined distance in the crimp recessed portion to 90% or less of the entire width of the crimp section. It is preferable to limit the predetermined distance to a value which ranges from 60% to 80% inclusive of the entire width of the crimp section. It is more preferable to limit the predetermined distance in the crimp recessed portion to which ranges from 45% to 80% inclusive of the entire width of the crimp section. By setting the predetermined distance in the crimp recessed portion in this manner, the more stable contact length can be ensured.

When the predetermined distance in the crimp recessed portion is set to a value smaller than 45% of the entire width of the crimp section, the predetermined distance in the crimp recessed portion becomes narrow and hence, there is a possibility that a crack occurs in the crimp recessed portion or a crimp die for forming the crimp recessed portion is damaged. Further, irregularity is liable to occur in compression ratio of the crimp section and hence, the insertion of the conductor exposed portion into the projecting portion due to crimp becomes difficult. Accordingly, a contact length between the conductor crimp section and the conductor exposed portion cannot be ensured or an oxide film of the conductor exposed portion cannot be sufficiently broken so that desired electric characteristics cannot be easily acquired.

On the other hand, when the predetermined distance in the crimp recessed portion is set to a value larger than 90% of the entire width of the crimp section, a width of the projecting portion in an approximately horizontal direction is narrowed and hence, the conductor exposed portion does not enter the projecting portion whereby a contact length between the conductor crimp section and the conductor exposed portion cannot be ensured so that desired electric characteristics cannot be easily acquired.

Further, the smaller an opposedly facing angle, the higher the tendency that the inclined portions are raised approximately upright becomes and hence, a wall thickness of the crimp recessed portion on a proximal end side is liable to be decreased by bending. Accordingly, a crack or the like is liable to occur in a thickness decreased portion of the crimp recessed portion due to thermal expansion, thermal contraction or the like.

Further, at the time of crimp the crimp section and the conductor exposed portion to each other, the inclined portions are plastically deformed such that the inclined portions are raised approximately upright and hence, it becomes difficult for the conductor exposed portion to smoothly enter the inner spaces of the projecting portions. Accordingly, in the crimp-connection structural body, a contact length between the crimp section and the conductor exposed portion cannot be stably ensured.

On the other hand, the larger the opposedly facing angle, the more difficult the formation of the projecting portion of the crimp section becomes. Accordingly, in the crimp-connection structural body, the conductor exposed portion cannot be strongly pressure-bonded by the crimp recessed portion of the crimp section and hence, a mechanical strength against a load generated at the time of pulling out the insulated wire from the crimp terminal cannot be ensured, for example. It is necessary to strongly pressure-bond the whole crimp section to ensure a mechanical strength. In this case, there is a possibility that the conductor exposed portion is disconnected due to the excessive plastic deformation.

Accordingly, when the opposedly facing angle goes beyond the predetermined range, in the crimp-connection structural body, the stable electrical connection cannot be ensured.

In view of the above, it is desirable to limit an opposedly facing angle made by the inclined portions which opposedly face each other in the radial direction to a value which ranges from 10° to 120° inclusive. It is more preferable to limit the opposedly facing angle to 90° or less. It is still more preferable to limit the opposedly facing angle to a value which ranges from 30° to 60° inclusive. By limiting the opposedly facing angle in this manner, in the crimp-connection structural body, the more stable electrical connection can be ensured.

By limiting a predetermined distance to 90% or less of an entire width of the crimp section and by limiting an opposedly facing angle made by the inclined portions which opposedly face each other in the radial direction to a value which ranges from 10° to 120° inclusive, in the crimp-connection structural body, a depth which is a length of the crimp recessed portion along a center axis can be optimized by limiting the depth to a value which falls within a predetermined range. By optimizing the depth of the crimp recessed portion, in the crimp-connection structural body, it is possible to prevent the depth of the crimp recessed portion from becoming excessively large or excessively small thus controlling a shape of the inner surface and a wall thickness of the projecting portions with more certainty.

With such a configuration, in the crimp-connection structural body, it is possible to stably ensure a contact length of a contact portion between the inner peripheral surface of the crimp section and the outer peripheral surface of the conductor exposed portion by controlling a shape of the inner surface, a wall thickness and the like of the projecting portions regardless of an outer diameter of the crimp section and an outer diameter of the conductor. Accordingly, in the crimp-connection structural body, it is possible to stably ensure a contact area between the crimp section and the conductor exposed portion in a long length direction of the crimp section having an approximately cylindrical shape. In addition, the conductor exposed portion can be strongly pressure-bonded by the crimp recessed portion and hence, in the crimp-connection structural body, both the electrical connection and the mechanical strength can be ensured.

Accordingly, in the crimp-connection structural body, stable conductivity can be ensured by controlling a cross-sectional shape of the crimp section in a crimp state in such a manner that a predetermined distance is limited to 90% or less of the entire width of the crimp section and an opposedly facing angle made by the inclined portions is limited to a value which ranges from 10° to 120° inclusive.

As the mode of the present invention, in the cross section in the radial direction, a sum of a cross-sectional area of the conductor exposed portion and a cross-sectional area of the crimp section in a crimp state may be set to a value which ranges from 40% to 90% inclusive of the sum of the cross-sectional area of the conductor exposed portion and the cross-sectional area of the crimp section in a pre-crimp state.

It is desirable to set a cross-sectional area of the conductor exposed portion in a crimp state to a value which ranges from 40% to 85% inclusive of a cross-sectional area of the conductor exposed portion in a pre-crimp state. In the case of the conductor exposed portion where a conductor is made of an aluminum-based material such as aluminum or an aluminum alloy, it is desirable to set a cross-sectional area of the conductor exposed portion in a crimp state to a value which ranges from 40% to 75% inclusive of a cross-sectional area of the conductor exposed portion in a pre-crimp state.

According to the present invention, in the crimp-connection structural body, both the electrical connection and the mechanical strength can be more stably ensured.

This will be described more specifically. With respect to a rate of a sum of a cross-sectional area of the conductor exposed portion and a cross-sectional area of the crimp section in a crimp state to a sum of the cross-sectional area of the conductor exposed portion and the cross-sectional area of the crimp section in a pre-crimp state, that is, a compression ratio, the smaller the compression ratio becomes, in the crimp-connection structural body, the more a state is likely to be brought about where the crimp section and the conductor exposed portion are excessively compressed to each other. Accordingly, there may be a case where the conductor exposed portion of the insulated wire is disconnected due to the elongation of the conductor exposed portion caused by crimp.

On the other hand, with respect to the rate of the sum of the cross-sectional area of the conductor exposed portion and the cross-sectional area of the crimp section in a crimp state to the sum of the cross-sectional area of the conductor exposed portion and the cross-sectional area of the crimp section in a pre-crimp state, that is, the compression ratio, the larger the compression ratio, in the crimp-connection structural body, the smaller a pressure at which the crimp section presses the conductor exposed portion becomes. Accordingly, for example, a mechanical strength against a load generated at the time of pulling out the insulated wire from the crimp terminal cannot be ensured.

Accordingly, when a rate of the sum of the cross-sectional area of the conductor exposed portion and the cross-sectional area of the crimp section in a crimp state to the sum of the cross-sectional area of the conductor exposed portion and the cross-sectional area of the crimp section in a pre-crimp state goes beyond a predetermined range, in the crimp-connection structural body, the electrical connection or a mechanical strength cannot be stably ensured.

In view of the above, it is desirable to limit the sum of the cross-sectional area of the conductor exposed portion and the cross-sectional area of the crimp section in a crimp state to a value which ranges from 40% to 90% inclusive of the sum of the cross-sectional area of the conductor exposed portion and the cross-sectional area of the crimp section in a pre-crimp state. By limiting the cross-sectional area to such a value, in the crimp-connection structural body, both the electrical connection and the mechanical strength can be ensured.

Accordingly, in the crimp-connection structural body, by limiting the sum of the cross-sectional area of the conductor exposed portion and the cross-sectional area of the crimp section in a crimp state to a value which ranges from 40% to 90% inclusive of the sum of the cross-sectional area of the conductor exposed portion and the cross-sectional area of the crimp section in a pre-crimp state, both the electrical connection and the mechanical strength can be ensured thus ensuring more stable conductivity.

As the mode of the present invention, a depth which is a length of the crimp recessed portion along a center axis in an approximately vertical direction which passes a center of the crimp section in a radial direction may be set to a value which ranges from 10% to 50% inclusive of a crimp height of the crimp section.

According to the present invention, in the crimp-connection structural body, the electrical connection between the crimp section and the conductor exposed portion can be more stably ensured.

This will be described more specifically. The deeper a depth of the crimp recessed portion becomes, the greater the possibility becomes where the conductor exposed portion is disconnected by the deeply formed crimp recessed portion or a wall thickness of the crimp recessed portion formed due to the plastic deformation is decreased so that a crack occurs in the crimp recessed portion.

On the other hand, the shallower the depth of the crimp recessed portion becomes, the greater the possibility becomes where the crimp recessed portion cannot strongly pressure-bond the conductor exposed portion so that, in the crimp-connection structural body, a mechanical strength between the crimp section and the conductor exposed portion cannot be stably ensured. Accordingly, when a depth of the crimp recessed portion goes beyond a predetermined range, in the crimp-connection structural body, the electrical connection between the crimp section and the conductor exposed portion cannot be stably ensured.

In view of the above, it is desirable to set a depth of the crimp recessed portion to a value which ranges from 10% to 50% inclusive of a crimp height. By setting a depth of the crimp recessed portion to such a value, in the crimp-connection structural body, the electrical connection between the crimp section and the conductor exposed portion can be stably ensured.

Accordingly, in the crimp-connection structural body, by limiting a depth of the crimp recessed portion to a value which ranges from 10% to 50% inclusive of a crimp height, the electrical connection between the crimp section and the conductor exposed portion can be more stably ensured whereby more stable conductivity can be ensured.

As the mode of the present invention, a ratio of the crimp height to an entire width of the crimp section may be set to a value which ranges from 1:0.4 to 1:1.1 inclusive.

According to the present invention, the crimp-connection structural body can be mounted in a cavity formed in a connector or the like with certainty, for example, in a state where an electrical connection is ensured.

This will be described more specifically. By measuring whether a crimp height falls within a predetermined range in a post-crimp state, in the crimp-connection structural body, it is possible to confirm a crimp state of the crimp section without cutting the crimp-connection structural body. Accordingly, when the crimp height goes beyond a predetermined range, it is determined that the crimp state of the crimp-connection structural body is defective.

However, the entire width of the crimp section is limited by a shape or a size of a cavity formed in a connector on which the crimp section is mounted, for example. In addition, at the time of connecting the crimp section and the conductor exposed portion to each other by crimp, a compression ratio of the conductor exposed portion and the crimp section is limited to a value which falls within a predetermined range from a viewpoint of ensuring the electrical connection between the conductor exposed portion and the crimp section.

In view of the above, the smaller a crimp height becomes with respect to the entire width of the crimp section, in the crimp-connection structural body, the greater the possibility becomes where the crimp section and the conductor exposed portion are excessively compressed so that the conductor exposed portion is disconnected due to the elongation of the conductor exposed portion caused by crimp. On the other hand, the larger a crimp height becomes with respect to the entire width of the crimp section, for example, the more a drawback is liable to be generated where the crimp-connection structural body cannot be mounted in the cavity formed in the connector.

Accordingly, with respect to the crimp-connection structural body where the conductor exposed portion is strongly pressure-bonded by the crimp recessed portion, for example, to mount the crimp-connection structural body in the cavity formed in the connector in a state where more stable conductivity is ensured, it is necessary to optimize the relationship between the entire width of the crimp section and the crimp height.

Accordingly, it is desirable to limit a ratio of a crimp height to an entire width of the crimp section to a value which ranges from 1:0.4 to 1:1.1. Due to the limitation of the ratio, the crimp-connection structural body can ensure the above-mentioned more stable electrical connection, and can be mounted with certainty in the cavity or the like formed in the connector.

Accordingly, by limiting a ratio of a crimp height to an entire width of the crimp section to a value which ranges from 1:0.4 to 1:1.1, the crimp-connection structural body can be mounted with certainty on a connector or the like while ensuring the more stable conductivity.

As the mode of the present invention, an inner surface projecting portion which is formed by projecting at least an inner surface of the crimp section inward in a radial direction is provided to the crimp section at a position on a side opposite to the crimp recessed portion in the radial direction in a crimp state.

The above-mentioned inner surface projecting portion may have a shape substantially equal to a shape of the crimp recessed portion in a radial cross section, a shape which differs from a shape of the crimp recessed portion, for example, a shape where only an inner surface portion is raised inward in the radial direction or the like.

According to the present invention, in the crimp-connection structural body, it is possible to sandwich the conductor exposed portion between the crimp recessed portion and the inner surface projecting portion of the crimp section. Accordingly, in the crimp-connection structural body, a mechanical strength between the crimp section and the conductor exposed portion can be further enhanced.

Further, due to the formation of the inner surface projecting portion, an inner peripheral length of the crimp section in cross section in a radial direction is elongated. In addition, a shape of an inner surface and a wall thickness of the projecting portions of the crimp section are controlled and hence, in the crimp-connection structural body, it is possible to make the conductor exposed portion enter inner spaces of the projecting portions even when the inner surface projecting portion is formed on the crimp section whereby a contact length between the conductor exposed portion and the crimp section can be elongated.

Accordingly, in the crimp-connection structural body, a mechanical strength between the crimp section and the conductor exposed portion can be enhanced and, at the same time, the electrical connection can be stably ensured.

Accordingly, in the crimp-connection structural body, due to the provision of the inner surface projecting portion which is disposed on a side oppose to the crimp recessed portion, more stable conductivity can be ensured.

As the mode of the present invention, a sealing portion which extends in the long length direction and seals a distal end of the crimp section in the long length direction may be provided to a distal end of the crimp section on a conductor exposed portion side.

According to the present invention, in the crimp-connection structural body, it is possible to prevent the intrusion of moisture from an opening of the crimp section on a conductor exposed portion side. Accordingly, in the crimp-connection structural body, it is possible to prevent the occurrence of a state where the electrical connection between the crimp section and the conductor exposed portion cannot be ensured due to corrosion of the conductor exposed portion caused by intruded moisture or the like.

Further, in the crimp-connection structural body, for example, by crimp the insulating cover of the insulated wire and the crimp section to each other, it is possible to easily bring the inside of the crimp section in a crimp state into a sealed state. Accordingly, in the crimp-connection structural body, the intrusion of moisture into the inside of the crimp section can be prevented with more certainty.

Accordingly, in the crimp-connection structural body, water-blocking performance can be ensured by the sealing portion and hence, the more stable conductivity can be ensured.

As the mode of the present invention, the conductor may be made of an aluminum-based material, and at least the crimp section may be made of a copper-based material.

The above-mentioned copper-based material may be copper, a copper alloy or the like. Further, the conductor made of an aluminum-based material may be formed using a core wire made of aluminum or an aluminum alloy or a stranded wire formed by stranding raw wires made of aluminum or an aluminum alloy.

According to the present invention, the crimp-connection structural body can be light-weighted while ensuring stable conductivity compared to a crimp-connection structural body including an insulated wire having a conductor formed of a copper wire.

However, when the conductor is made of an aluminum-based material, and the crimp section is made of a copper-based material, so-called dissimilar metal corrosion (hereinafter referred to as "galvanic corrosion") may occur as a drawback due to the intrusion of moisture into the inside of the crimp section.

This will be described in more detail. In a closed-barrel-type crimp terminal, when moisture intrudes into the inside of the crimp section, there arises a drawback such as the increase of electric resistance due to oxidization and corrosion of a metal surface of a conductor or a crimp section. Particularly, in the case where a copper-based material which has been conventionally used for forming a conductor of an insulated wire is replaced by an aluminum-based material such as aluminum or an aluminum alloy, and the conductor made of an aluminum-based material is pressure-bonded to a crimp terminal, there arises a phenomenon where the aluminum-based material which is less noble metal is corroded due to contact between less noble metal and nobler metal material such as tin plating, gold plating or a copper alloy which is a terminal material, that is, galvanic corrosion occurs.

Galvanic corrosion is a phenomenon where when moisture adheres to a portion where a nobler metal material and less noble metal are brought into contact with each other, a corrosion electric current is generated so that corrosion, dissolving, dissipation or the like of less noble metal occurs. Due to such phenomenon, the conductor exposed portion made of an aluminum-based material which is pressure-bonded by the crimp section of the crimp terminal is corroded, dissolved or dissipated thus eventually increasing electric resistance. As a result, there arises a drawback that the crimp-connection structural body cannot perform sufficient conductive property.

On the other hand, in a closed-barrel-type crimp terminal, water-blocking performance against the intrusion of moisture into the inside of the crimp section can be easily ensured by sealing an opening of the crimp section using a sealing member provided as a separate member or by sealing the opening of the crimp section by caulking. Accordingly, in the crimp-connection structural body, so-called galvanic corrosion can be prevented while achieving the reduction of weight compared to a crimp-connection structural body including an insulated wire having a conductor made of a copper-based material.

Accordingly, in the crimp-connection structural body, stable conductivity can be ensured while achieving the reduction of weight irrespective of a kind of metal which forms the conductor of the insulated wire. Further, in the crimp-connection structural body, more stable conductivity can be ensured by ensuring water-blocking performance by sealing the opening of the crimp section or the like.

The present invention is also directed to a wire harness including a plurality of crimp-connection structural bodies described above.

According to the present invention, it is possible to form the wire harness which ensures favorable conductivity using a plurality of crimp-connection structural bodies where stable conductivity is ensured by controlling a cross-sectional shape of the crimp section in a crimp state.

A crimp terminal of the above-mentioned crimp-connection structural body may be a connector disposed in the inside of a connector housing, for example, a single-pole connector or the like.

The present invention is also directed to a method of manufacturing a crimp-connection structural body and a device of manufacturing a crimp-connection structural body, the crimp-connection structural body including an insulated wire formed by covering a conductive conductor by an insulating cover having insulation property; and a crimp terminal having a crimp section which allows connection by crimp of a conductor exposed portion formed by exposing the conductor by removing at least a portion of the insulating cover in a vicinity of a distal end of the insulating cover to the crimp section, the conductor exposed portion is connected to the crimp section by crimp. The manufacturing method sequentially performs: an inserting step of inserting at least a conductor exposed portion into a closed-barrel-type crimp section having an approximately cylindrical shape and extending in a long length direction of the insulated wire; and a crimp step of forming a cross-sectional shape of the crimp section in a radial direction into an approximately recessed cross-sectional shape and crimp the conductor exposed portion and the crimp section to each other by forming the crimp section such that a crimp recessed portion having two inclined portions inclined inward from positions of the crimp section spaced apart from each other by a distance which is 90% or less of an entire width of the crimp section in an approximately horizontal direction is formed by indenting the crimp section while setting an opposedly facing angle made by the two inclined portions of the crimp recessed portion to a value which ranges from 10° to 120° inclusive. The manufacturing device includes means for performing these steps.

According to the present invention, stable conductivity can be ensured by controlling a cross-sectional shape of the crimp section in a crimp state.

This will be described more specifically. By forming the crimp recessed portion such that the predetermined distance is limited to 90% or less of the entire width of the crimp section and the opposedly facing angle made by the inclined portions is limited to a value which ranges from 10° to 120° inclusive, the method of manufacturing a crimp-connection structural body and the device of manufacturing a crimp-connection structural body can form the projecting portions having a width which ensures a predetermined rate to the entire width of the crimp section at the time of forming the projecting portions on the crimp section adjacently to both ends of the crimp recessed portion.

Accordingly, in the method of manufacturing a crimp-connection structural body and the device of manufacturing a crimp-connection structural body, a shape of an inner surface and a wall thickness of the projecting portions can be more easily controlled and hence, a contact length between an inner peripheral surface of the crimp section and an outer peripheral surface of the conductor exposed portion can be more stably ensured.

Accordingly, in the method of manufacturing a crimp-connection structural body and the device of manufacturing a crimp-connection structural body, stable conductivity can be ensured by controlling a cross-sectional shape of the crimp section in a crimp state in such a manner that the crimp recessed portion is formed by limiting the predetermined distance to 90% or less of an entire width of the crimp section and by limiting an opposedly facing angle made by the inclined portions to a value which ranges from 10° to 120° inclusive.

It is preferable to limit the predetermined distance to a value which ranges from 60% to 80% inclusive of an entire width of the crimp section. It is also preferable to limit an opposedly facing angle made by the inclined portions to 90° or less. It is more preferable to limit the opposedly facing angle made by the inclined portions to a value which ranges from 30° to 60° inclusive.

As the mode of the present invention, the crimp step may include a step where an inner surface projecting portion may be formed by projecting at least an inner surface of the crimp section inward in a radial direction at a position of the crimp section on a side opposite to the crimp recessed portion in the radial direction, and the inner surface projecting portion and the crimp recessed portion may be formed simultaneously. Further, the crimp means may include a means which performs such a step.

According to the present invention, in the method of manufacturing a crimp-connection structural body and the device of manufacturing a crimp-connection structural body, the crimp recessed portion and the inner surface projecting portion which sandwich the conductor exposed portion can be efficiently formed on the crimp section. Accordingly, in the method of manufacturing a crimp-connection structural body and the device of manufacturing a crimp-connection structural body, a mechanical strength between the crimp section and the conductor exposed portion can be further enhanced and, at the same time, the crimp section and the conductor exposed portion can be efficiently connected to each other by crimp.

Further, an inner peripheral length of the crimp section in cross section in a radial direction can be elongated, and a shape of an inner surface and a wall thickness of the projecting portions of the crimp section can be easily controlled. Accordingly, in the method of manufacturing a crimp-connection structural body and the device of manufacturing a crimp-connection structural body, the conductor exposed portion can be made to enter the inner spaces of the crimp section without a gap and hence, the crimp section and the conductor exposed portion can be connected to each other by crimp.

With such a configuration, in the method of manufacturing a crimp-connection structural body and the device of manufacturing a crimp-connection structural body, it is possible to manufacture the crimp-connection structural body where a mechanical strength between the crimp section and the conductor exposed portion can be enhanced and, at the same time, the electrical connection can be stably ensured.

Accordingly, in the method of manufacturing a crimp-connection structural body and the device of manufacturing a crimp-connection structural body, it is possible to manufacture the crimp-connection structural body where more stable conductivity can be ensured by forming the crimp recessed portion and the inner surface projecting portion simultaneously.

Effects of the Invention

According to the present invention, it is possible to provide a crimp-connection structural body, a wire harness, a method of manufacturing a crimp-connection structural body, and a device of manufacturing a crimp-connection structural body where stable conductivity can be ensured by controlling a cross-sectional shape of the crimp section in a crimp state.

EMBODIMENTS OF THE INVENTION

One embodiment of the present invention is described by reference to drawings hereinafter.

Firstly, a crimp-connection structural body 1 of the present embodiment is described in detail by reference to FIG. 1 to FIG. 5.

Figure 1:
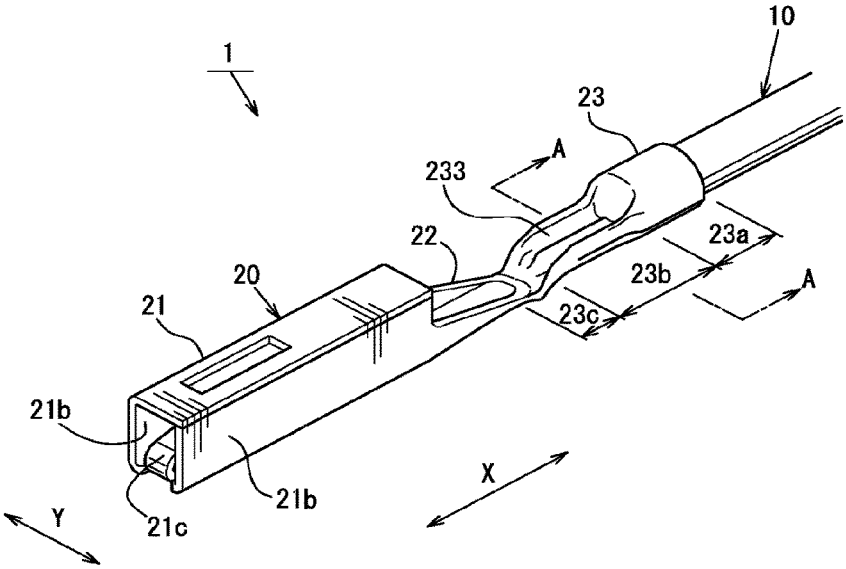
FIG. 1 is an external appearance perspective view showing an external appearance of a crimp-connection structural body as viewed from above.
Figure 2A:
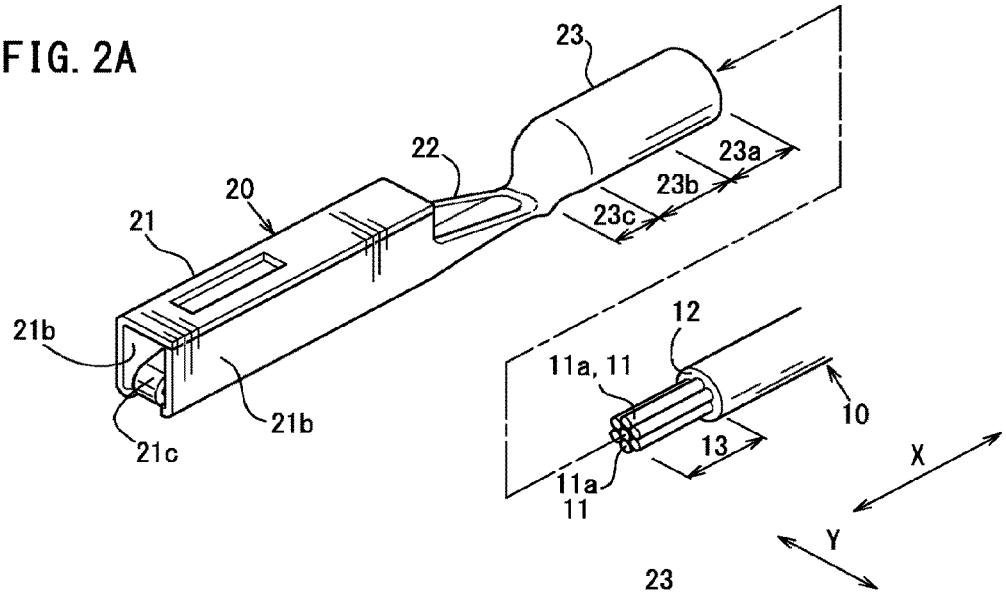
FIG. 2A and FIG. 2B are explanatory views for describing an insulated wire and a crimp terminal.
Figure 2B:
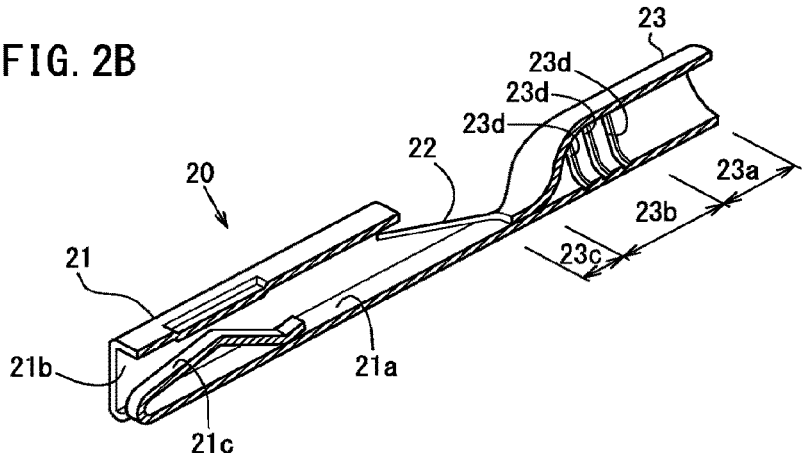
Figure 3:
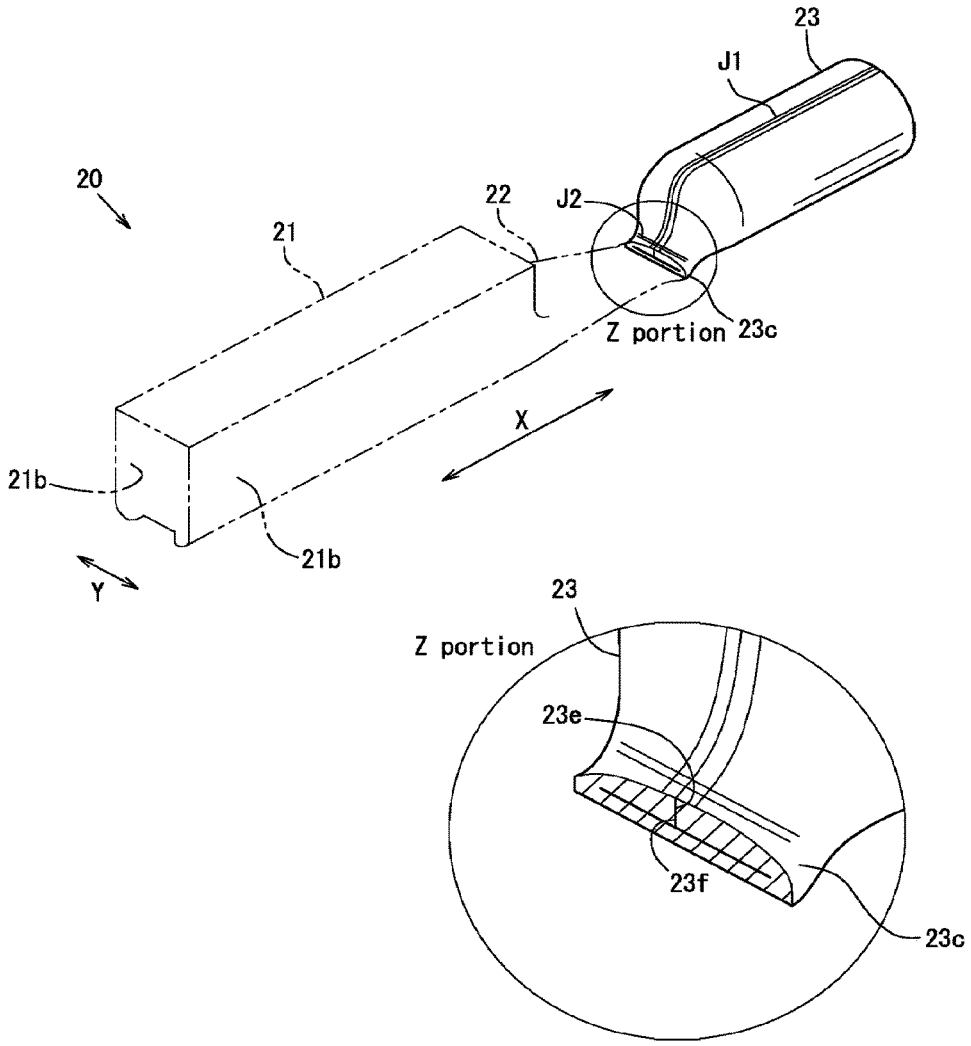
FIG. 3 is an explanatory view for describing welding of a crimp section.
Figure 4:
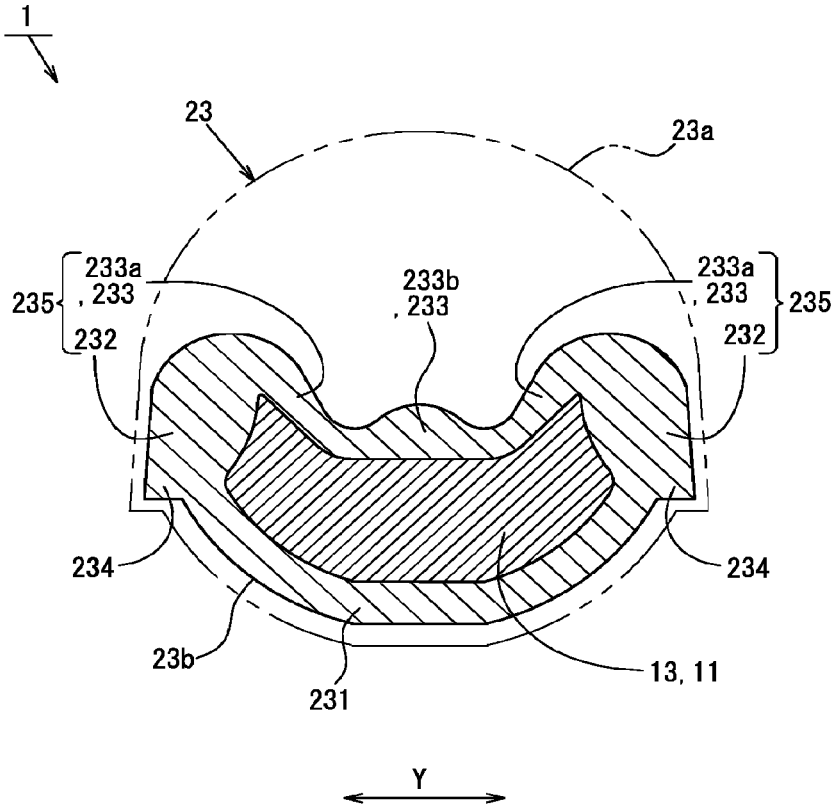
FIG. 4 is a cross-sectional view of the crimp-connection structural body as viewed in a direction indicated by arrows A-A in FIG. 1.
Figure 5:
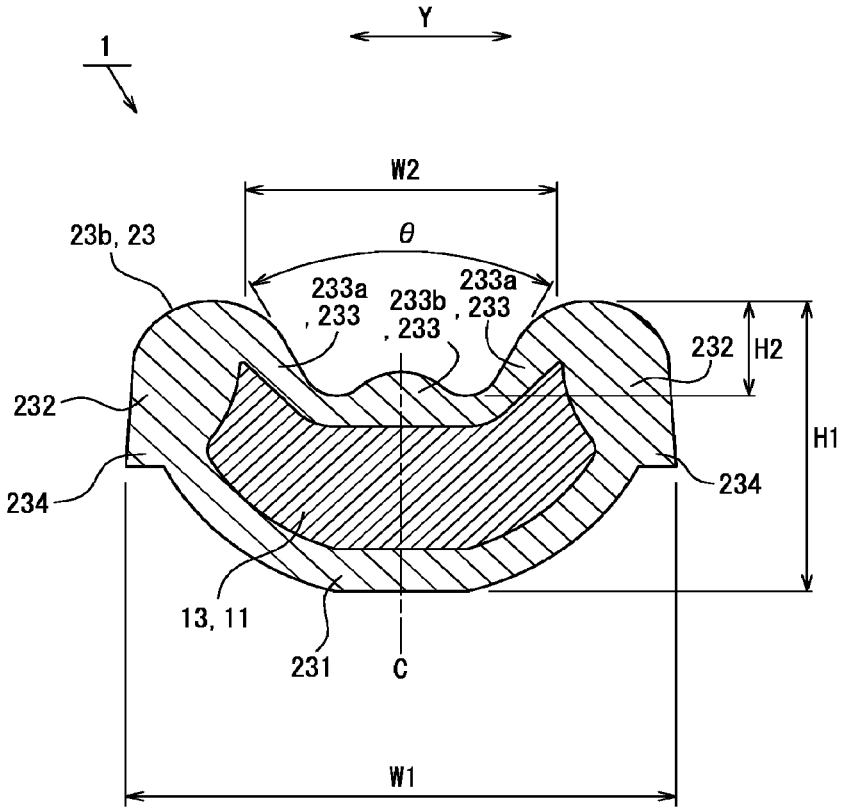
FIG. 5 is an explanatory view for describing a conductor crimp section in a crimp state.

FIG. 1 is an external appearance perspective view of the crimp-connection structural body 1 as viewed from above; FIG. 2A and FIG. 2B are explanatory views for describing an insulated wire 10 and a crimp terminal 20; FIG. 3 is an explanatory view for describing welding of a crimp section 23; FIG. 4 is a cross-sectional view of the crimp-connection structural body 1 as viewed in a direction indicated by arrows A-A in FIG. 1; and FIG. 5 is an explanatory view for describing a core wire crimp section 23*b* in a crimp state.

In FIG. 1, an arrow X indicates a long length direction (hereinafter referred to as "long length direction X"), and an arrow Y indicates a width direction (hereinafter referred to as "width direction Y"). Further, in the long length direction X, a box portion 21 side (a left side in FIG. 1) described later is referred to as a front side, and an insulated wire 10 side described later is referred to as a rear side with respect to a box portion 21 (a right side in FIG. 1). In addition, an upper side in FIG. 1 is referred to as an upper side, and a lower side in FIG. 1 is referred to as a lower side.

Further, with respect to FIG. 2A and FIG. 2B, FIG. 2A is an external appearance perspective view of the insulated wire 10 and the crimp terminal 20, and FIG. 2B is a cross-sectional perspective view of the crimp terminal 20 in a pre-crimp state taken along a long length direction X. In FIG. 4, a cover crimp section 23*a* is indicated by a chain double-dashed line.

As shown in FIG. 1, the crimp-connection structural body 1 includes: the insulated wire 10; and the crimp terminal 20 which is pressure-bonded to the insulated wire 10 by caulking.

As shown in FIG. 2A, the insulated wire 10 is formed such that an aluminum core wire 11 formed by binding a plurality of aluminum raw wires 11*a* is covered by an insulating cover 12 made of an insulating resin. For example, the aluminum core wire 11 is formed by stranding aluminum raw wires 11*a* such that the aluminum core wire 11 has a cross section of 2.5 $mm^2$ Further, in the insulated wire 10, by peeling off the insulating cover 12 of the insulated wire 10 by a predetermined length from a tip end of the insulated wire 10 in a long length direction X thus exposing the aluminum core wire 11, a core wire exposed portion 13 can be formed.

As shown in FIG. 2A and FIG. 2B, the crimp terminal 20 is a female terminal, and is an integral body formed of: the box portion 21 which allows the insertion of a male tab of a male terminal not shown in the drawing therein from a front side to a rear side in a long length direction X; and a crimp section 23 which is disposed behind the box portion 21 with a transition section 22 having a predetermined length disposed therebetween.

The crimp terminal 20 is a closed barrel-type terminal which is formed such that a copper alloy strip (not shown) made of brass or the like which has a plate thickness of 0.25 mm and has a surface thereof plated with tin (Sn plating) is blanked in a terminal shape developed in plane and, thereafter, the strip is bent into a stereoscopic terminal shape thus forming the box portion 21 having a hollow quadrangular columnar body and the crimp section 23 having an approximately O shape as viewed from a rear side, and the crimp section 23 is welded.

As shown in FIG. 2A, the box portion 21 is formed such that one of side surface portions 21*b* formed on both sides of a bottom surface portion 21*a* in a width direction Y in a raised manner is bent so as to overlap with an edge portion of the other of the side surface portions 21*b* so that the box portion 21 is formed of a hollow quadrangular columnar body in a laying-down state having an approximately rectangular shape as viewed from a front side in the long length direction X.

As shown in FIG. 2B, in the inside of the box portion 21, a resilient contact lug 21*c* which is brought into contact with an inserting tab (not shown) of a male terminal to be inserted is disposed. The resilient contact lug 21*c* is formed by extending a front side of the bottom surface portion 21*a* in the long length direction X and by folding the extending portion toward a rear side in the long length direction X.

As shown in FIG. 1, FIG. 2A and FIG. 2B, the crimp section 23 is an integral body formed of: a cover crimp section 23*a* which pressure-bonds the insulating cover 12; a core wire crimp section 23*b* which pressure-bonds the core wire exposed portion 13; and a sealing portion 23*c* which is formed by deforming an end portion in front of the core wire crimp section 23*b* in such a manner that the end portion is collapsed into an approximately flat plate shape. The cover crimp section 23*a*, the core wire crimp section 23*b*, and the sealing portion 23*c* are disposed in this order from the rear side in the long length direction X.

Both the cover crimp section 23*a* and the core wire crimp section 23*b* are formed into approximately cylindrical shapes and have substantially the same inner and outer diameters. As shown in FIG. 2B, three serration portions 23*d* are formed on an inner peripheral surface of the core wire crimp section 23*b* at predetermined intervals in a long length direction X such that the serration portions 23*d* are indented toward an outside in a radial direction in cross section as viewed in the long length direction X, and are continuously formed along a circumferential direction.

As shown in FIG. 3, the crimp section 23 is formed into an approximately O shape as viewed from a rear side such that a copper alloy strip blanked in a terminal shape is rounded into a cylindrical shape having an inner diameter substantially equal to an outer diameter of the insulated wire 10 or slightly larger than the outer diameter of the insulated wire 10 so as to surround an outer periphery of the insulated wire 10, and edge portions 23*e*, 23*f* of the rounded crimp section 23 are made to abut against each other, and are welded together along a welded portion J1 in the long length direction X. In other words, the crimp section 23 is formed so as to have a closed cross-sectional shape in cross section taken along a width direction Y.

Further, as shown in FIG. 3, the sealing portion 23*c* of the crimp section 23 is collapsed by pressing so as to close a front end in the long length direction X of the crimp section 23 where the edge portions 23*e*, 23*f* are welded to each other and, at the same time, the sealing portion 23*c* of the crimp section 23 is sealed by welding along a welded portion J2 in the width direction Y.

That is, the crimp section 23 is formed into an approximately cylindrical shape having an opening on a rear side of the crimp section 23 in the long length direction X by welding to close the front end of the crimp section 23 in the long length direction X and the edge portions 23*e*, 23*f* of the crimp section 23.

In forming the welded portion J1 and the welded portion J2, when welding which requires pressure welding such as ultrasonic welding or resistance welding is used, there is a possibility that necking occurs due to the pressure welding so that a material strength of the welded portion is lowered. Accordingly, it is preferable to form the welded portion J1 and the welded portion J2 using welding which requires no pressure welding such as laser welding, for example.

Further, as shown in FIG. 4, the core wire crimp section 23*b* in a crimp state has, in cross section taken along a width direction Y, an approximately recessed shape where an upper portion of the core wire crimp section 23*b* is indented due to plastic deformation caused by crimp and, at the same time, the core wire crimp section 23*b* presses the core wire exposed portion 13 by an inner peripheral surface thereof thus bringing about the crimp state.

The core wire crimp section 23*b* in a crimp state is pressure-bonded such that a ratio of a crimp height H1 (see FIG. 5) which is a length of the core wire crimp section 23*b* in a crimp state in an up-and-down direction to an entire width W1 (see FIG. 5) which is a length of the core wire crimp section 23*b* in a crimp state in a width direction Y ranges from 1:0.4 to 1:1.1.

This will be described in more detail. As shown in FIG. 4 and FIG. 5, the core wire crimp section 23*b* in the crimp state has an approximately recessed shape in cross section formed of: a pressure-bonded bottom portion 231 which is plastically deformed into an approximately arcuate shape and having a large width in a width direction Y; pressure-bonded side portions 232 which are continuously formed with the pressure-bonded bottom portion 231 and extend in an approximately upward direction; and a crimp recessed portion 233 which is continuously formed with upper ends of the pressure-bonded side portions 232 in a gently curved manner and is indented downward.

Further, a lower portion of the pressure-bonded bottom portion 231 is formed such that an outer peripheral surface of the pressure-bonded bottom portion 231 has an approximately flat surface. In addition, on boundaries between the pressure-bonded side portions 232 and the pressure-bonded bottom portion 231, a recessed portion 234 which is plastically deformed so as to project to the outside in a width direction Y is formed by a set of male-and-female die 151 described later (see FIG. 7).

As shown in FIG. 4, the crimp recessed portion 233 has an approximately inverted trapezoidal shape in cross section taken along a width direction Y, and is formed of: inclined portions 233*a* which are inclined inward in a radial direction from positions spaced apart from each other by a predetermined distance W2 in the width direction Y; and a raised bottom portion 233*b* which extend approximately horizontally between lower ends of the inclined portions 233*a* and is plastically deformed. The crimp recessed portion 233 is formed such that, in a crimp state, the predetermined distance W2 is set to 90% or less of the entire width W1 of the core wire crimp section 23*b*, and is preferably set to 80% or less of the entire width W1 of the core wire crimp section

23*b*. The crimp recessed portion 233 may be formed such that a lower limit of the distance W2 is set to 45% or more of the entire width W1 of the core wire crimp section 23*b*, and is preferably set to 60% or more of the entire width W1 of the core wire crimp section 23*b*.

Two inclined portions 233*a* are formed to have substantially the same inclination angle with respect to a center axis C which extends approximately vertically and passes the center of the core wire crimp section 23*b* in a radial direction. Two inclined portions 233*a* are formed such that an opposedly facing angle θ made by two inclined portions 233*a* which opposedly face each other in a width direction Y is limited to a value which ranges from 10° to 120° inclusive, is preferably limited to 90° or less, and is further preferably limited to a value which ranges from 30° to 60° inclusive.

By a male-and-female die 151 described later, the raised bottom portion 233*b* is formed into a shape where a portion of an outer peripheral surface of the raised bottom portion 233*b* approximately at the center in the width direction Y is raised upward.

The crimp recessed portion 233 formed of the inclined portions 233*a* and the raised bottom portion 233*b* is formed such that a length of each inclined portion 233*a* along the center axis C between an upper end and a lower end of an outer peripheral surface of the inclined portion 233*a*, that is, a depth H2 of the crimp recessed portion 233 is limited to a value which ranges from 10% to 50% inclusive of the crimp height H1 of the core wire crimp section 23*b* in a crimp state.

By the inclined portions 233*a* of the crimp recessed portion 233 and the pressure-bonded side portions 232, projecting portions 235 each of which projects upward and has an inner space are formed on the crimp section 23 in a crimp state. In the projecting portions 235, by limiting the predetermined distance W2 with respect to the entire width W1 of the core wire crimp section 23*b* and the opposedly facing angle θ made by two inclined portions 233*a*, the shapes of inner surfaces of the projecting portions 235 are controlled thus suppressing entering of the aluminum raw wires 11*a*.

This will be described in more detail. By limiting the predetermined distance W2 with respect to the entire width W1 of the core wire crimp section 23*b* and the opposedly facing angle θ made by two inclined portions 233*a*, a width W3 of the projecting portion 235 in a width direction Y (see FIG. 5) is limited to a value equal to or less than a value obtained by adding a diameter of the aluminum raw wire 11*a* to a value twice as large as a plate thickness of the pressure-bonded bottom portion 231 of the core wire crimp section 23*b*. With such a configuration, the core wire crimp section 23*b* in a crimp state is more strongly pressure-bonded to the aluminum core wire 11.

Next, a method of manufacturing the crimp-connection structural body 1 having such a configuration and a manufacturing device 100 are described in detail by reference to FIG. 6 to FIG. 10.

Figure 6:
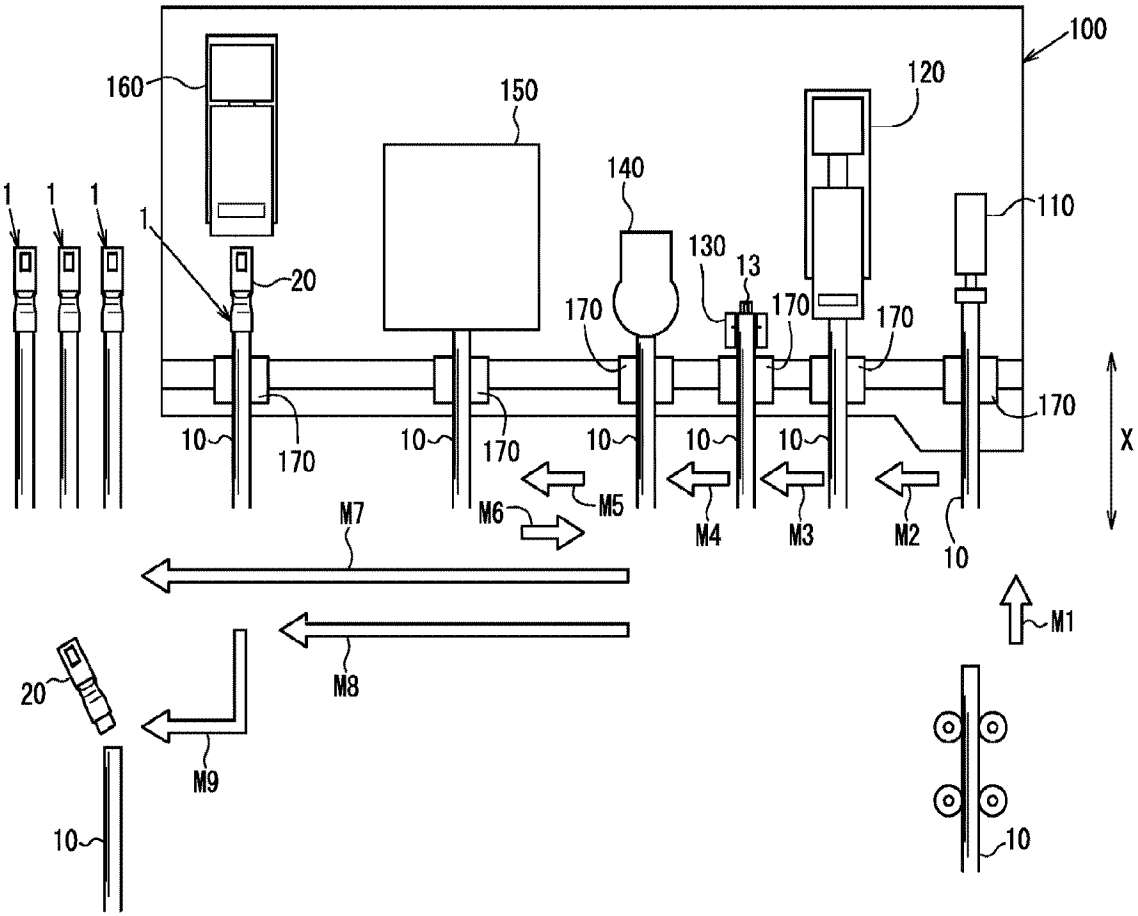
FIG. 6 is a plan view showing an external appearance of a manufacturing device as viewed from above.
Figure 7B:
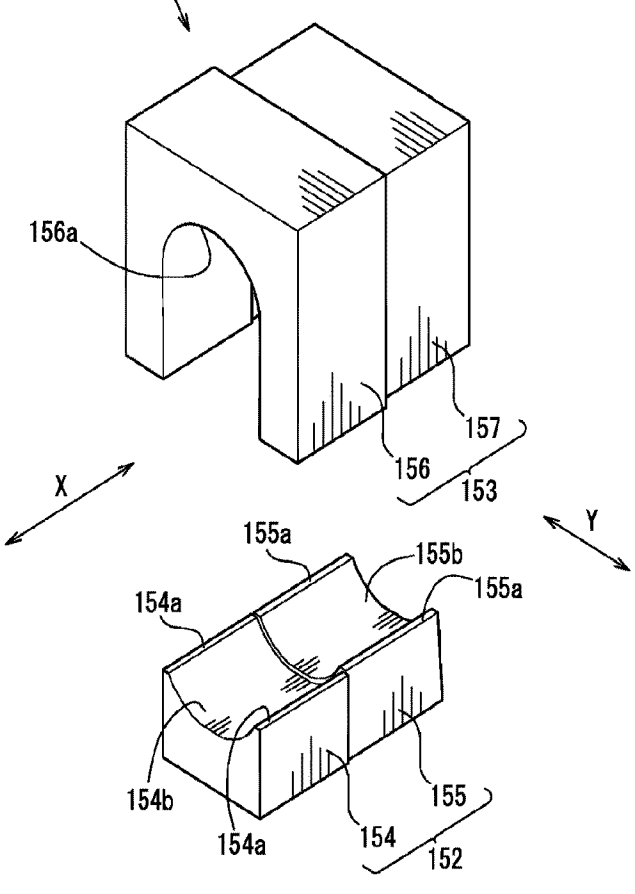
FIG. 7A and FIG. 7B are explanatory views for describing female and male dies.
Figure 8:
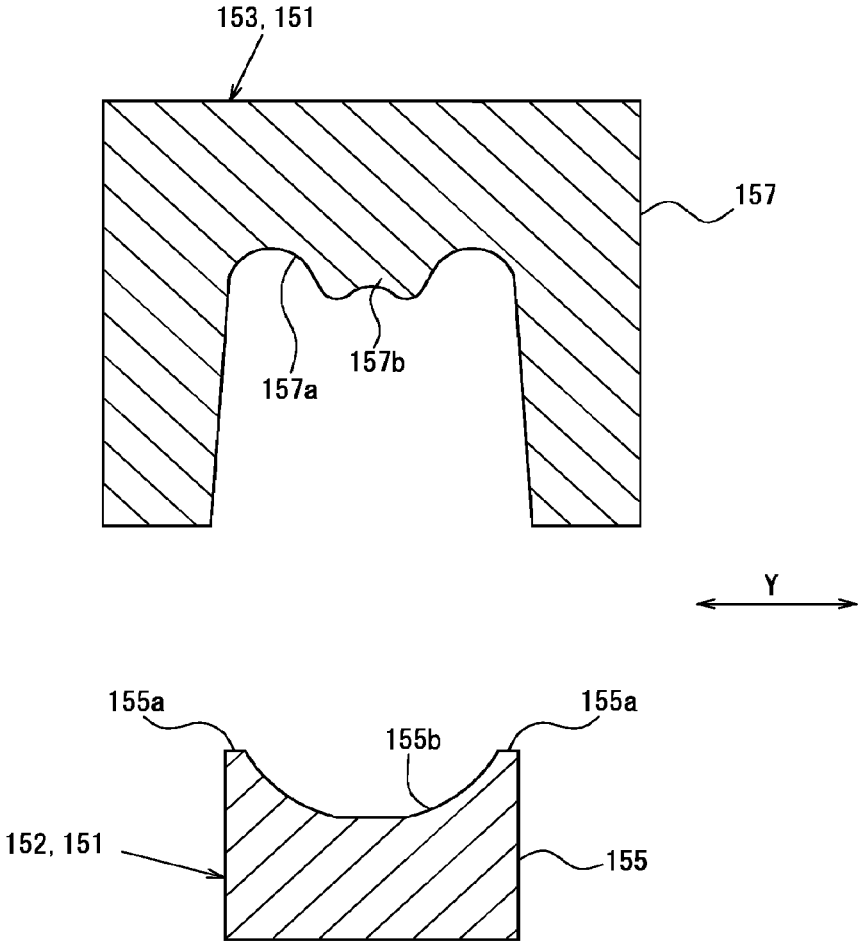
FIG. 8 is a cross-sectional view showing cross sections of conductor crimp portions of the female and male dies taken along a width direction.
Figure 9:
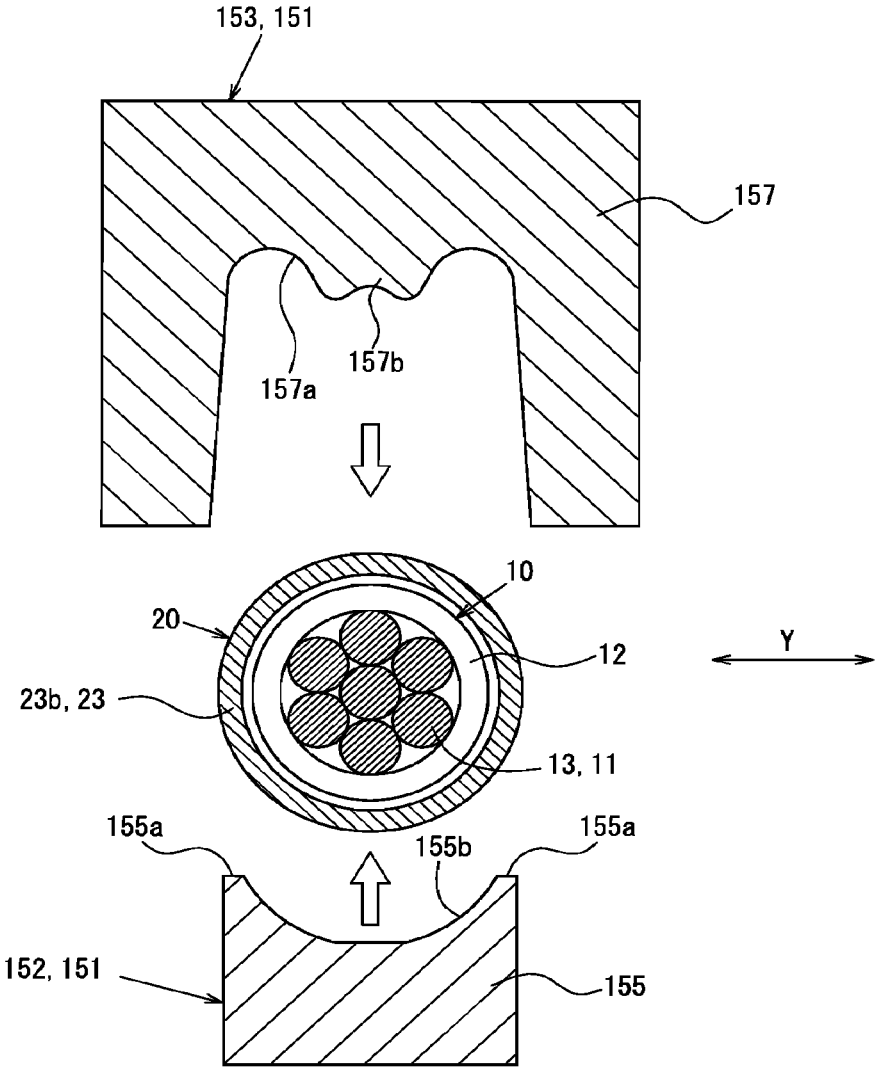
FIG. 9 is a cross-sectional view of the conductor crimp section in a first stage of a crimp step as viewed in a direction indicated by arrows A-A.
Figure 10A:
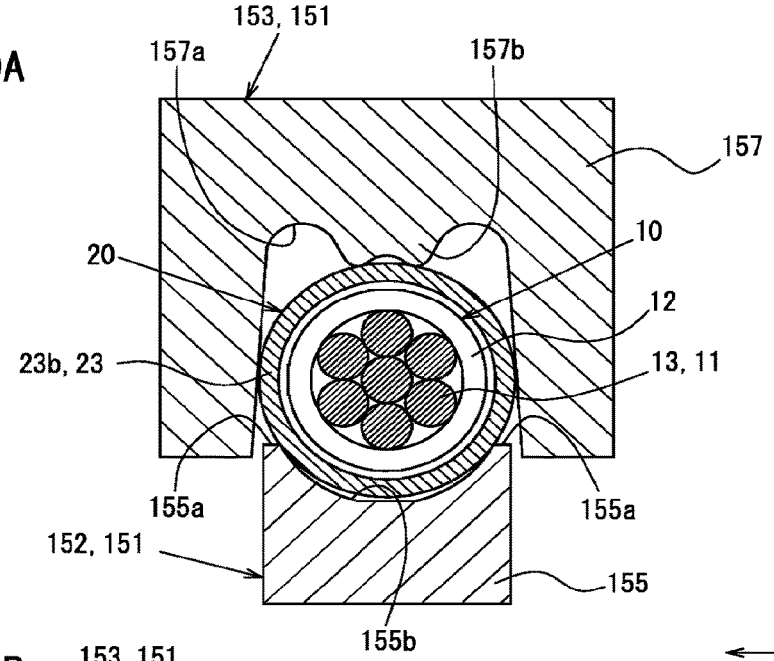
FIG. 10A and FIG. 10B are cross-sectional views of the conductor crimp section in a second stage of the crimp step as viewed in a direction indicated by arrows A-A.
Figure 10B:
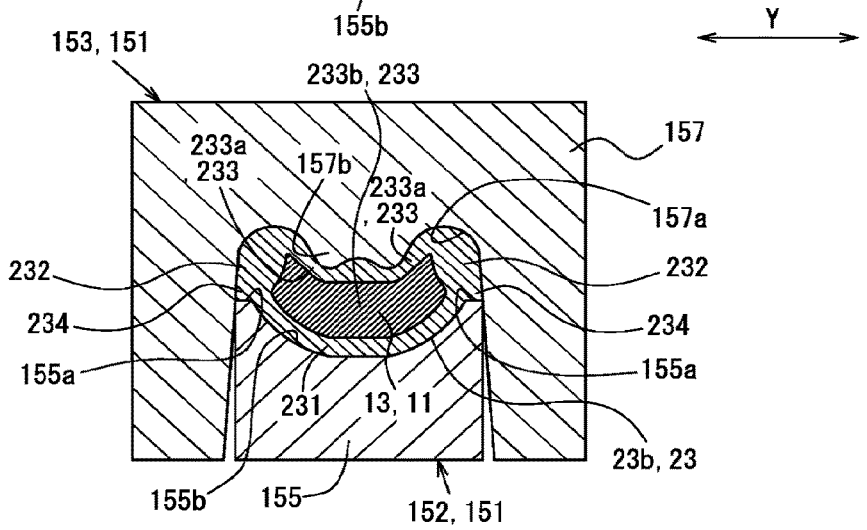

FIG. 6 is a plan view of an external appearance of the manufacturing device 100, 7A and FIG. 7B are explanatory views for describing the male-and-female dies 151, FIG. 8 is a cross-sectional view of core wire crimp portions 155, 157 of the male-and-female die 151 taken along a width direction Y, FIG. 9 is a cross-sectional view of the core wire crimp section 23*b* in a first stage of a crimp step as viewed in a direction indicated by arrows A-A, and FIG. 10A and FIG. 10B are cross-sectional views of the core wire crimp section 23*b* in a second stage of the crimp step as viewed in a direction indicated by arrows A-A.

Figure 7A:
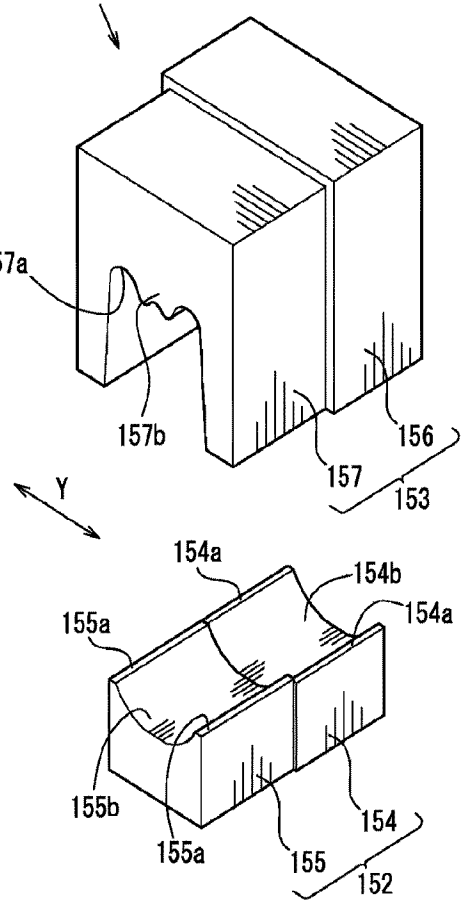

FIG. 7A is an external appearance perspective view of the male-and-female die 151 as viewed from a front side, and FIG. 7B is an external appearance perspective view of the male-and-female die 151 as viewed from a rear side.

Firstly, as shown in FIG. 6, the manufacturing device 100 which manufactures the crimp-connection structural body 1 is configured by arranging a tip end detection step part 110, a cover stripping step part 120, a marking step part 130, an inspection step part 140, a crimp step part 150, and a defective product removing step part 160 in this order. The manufacturing device 100 includes a conveyance step part 170 which is a conveyance means configured to be movable between the tip end detection step part 110 and the defective product removing step part 160 and to convey the insulated wire 10 and the crimp-connection structural body 1.

The tip end detection step part 110 is formed of a contact sensor or the like, and has a function of detecting a tip end of the conveyed insulated wire 10.

The cover stripping step part 120 includes, for example, a cover removing blade die which has a V-shaped cross section and is vertically split in two (not shown), a moving mechanism which moves the cover removing blade die in a predetermined direction (not shown) and the like. The cover stripping step part 120 has a function of exposing the aluminum core wire 11 by removing a portion of the insulating cover 12 having a predetermined length from the tip end of the conveyed insulated wire 10.

The marking step part 130 includes: a paint tank (not shown), a jetting port from which a paint is jetted (not shown) and the like, and has a function of forming a mark by jetting a paint on the insulated wire 10 at a predetermined position.

The inspection step part 140 is formed of an image sensor (not shown) or the like. The inspection step part 140 acquires image data by imaging a portion of the conveyed insulated wire 10 in the vicinity of the tip end of the insulated wire 10 from above, and has a function of detecting a state of the portion of the insulated wire 10 in the vicinity of the tip end of the insulated wire 10 based on the imaged image data.

The crimp step part 150 includes: a conveying mechanism (not shown) for continuously conveying the crimp terminal 20; the male-and-female die 151 which pressure-bonds the crimp section 23 (see FIG. 7); a moving mechanism (not shown) for moving the male-and-female the 151 in a predetermined direction, and the like. The crimp step part 150 has a function of conveying the crimp terminal 20 and a function of crimp the insulated wire 10 which is inserted into the crimp section 23. The male-and-female die 151 will be described in detail later.

The defective product removing step part 160 includes a cutting blade die (not shown) for cutting the insulated wire 10, a moving mechanism (not shown) for moving the cutting blade die in a predetermined direction, and the like, and has a function of cutting the insulated wire 10 of the crimp-connection structural body 1 where a crimp state is determined to be defective.

The conveyance step part 170 includes a holding mechanism (not shown) for holding the insulated wire 10, a moving mechanism (not shown) for moving the holding mechanism, and the like. The conveyance step part 170 has a function of holding the insulated wire 10, a function of conveying the holding insulated wire 10 to respective steps, and a function of conveying the insulated wire 10 in the long length direction X.

As shown in FIG. 7A and FIG. 7B, the above-mentioned male-and-female die 151 of the crimp step part 150, for example, has the vertically two-split structure formed of a male die 152 and a female die 153 having a length in the long length direction X which enables the male die 152 and the female die 153 to pressure-bond the crimp section 23. The male die 152 is formed of an integral body consisting of: a cover crimp portion 154 which pressure-bonds the insulating cover 12 and the cover crimp section 23*a* to each other; and a core wire crimp portion 155 which pressure-bonds the core wire exposed portion 13 and the core wire crimp section 23*b* to each other. In the same manner, the female die 153 is formed of an integral body consisting of: a cover crimp portion 156 which pressure-bonds the insulating cover 12 and the cover crimp section 23*a* to each other; and a core wire crimp portion 157 which pressure-bonds the core wire exposed portion 13 and the core wire crimp section 23*b* to each other.

This will be described in more detail. The cover crimp portion 154 of the male die 152 is formed into an approximately rectangular cross-sectional shape having a width slightly smaller than an outer diameter of the crimp section 23 of the crimp terminal 20 in cross section taken along a width direction Y. On the cover crimp portion 154 of the male die 152, a first male side recessed portion 154*b* having an approximately semicircular cross-sectional shape which is indented downward with a diameter slightly smaller than the outer diameter of the crimp section 23 is formed such that the first male side recessed portion 154*b* is interposed between flat surface portions 154*a* formed on both ends of the cover crimp portion 154 in a width direction Y.

The core wire crimp portion 155 of the male die 152 is formed into an approximately rectangular cross-sectional shape having a width substantially equal to the entire width W1 of the core wire crimp section 23*b* in a crimp state. On the core wire crimp portion 155 of the male the 152, a second male side recessed portion 155*b* having an approximately semicircular cross-sectional shape which is indented downward with a diameter slightly smaller than the outer diameter of the crimp section 23 is formed such that the second male side recessed portion 155*b* is interposed between flat surface portions 155*a* formed on both ends of the core wire crimp portion 155 in a width direction Y. A bottom surface of the second male side recessed portion 155*b* is formed into an approximately flat surface shape in cross section taken along a width direction Y.

The cover crimp portion 156 of the female the 153 is formed into an approximately gate shape in cross section taken along a width direction Y by forming a first female side recessed portion 156*a* having an approximately inverted U shape and having a diameter slightly smaller than an outer diameter of the crimp section 23 on the cover crimp portion 156 by indenting. The cover crimp portion 156 has a size which allows the cover crimp portion 154 of the male the 152 to be fitted in the cover crimp portion 156.

The core wire crimp portion 157 of the female die 153 is formed into an approximately gate shape in cross section taken along a width direction Y by forming a second female side recessed portion 157*a* on the core wire crimp portion 157 by indenting upwardly. On an upper surface portion of the second female side recessed portion 157*a*, a projecting portion 157*b* which is continuously formed with inner side surfaces having an approximately gate shape in a gradually curved manner and projects downward with a length in the up-and-down direction substantially equal to the above-mentioned depth H2 is formed substantially at the center in the width direction Y.

The projecting portion 157*b* is formed into an approximately W-shaped cross-sectional shape in cross section taken along a width direction Y where the projecting portion 157*b* is inclined obliquely downward from positions spaced apart from each other by a distance substantially equal to the above-mentioned predetermined distance W2 and, subsequently, the projecting portion 157*b* is indented such that lower ends of the obliquely downward inclined portions are curved upwardly from lower ends thereof. An opposedly facing angle made by the obliquely downward inclined portions of the projecting portion 157*b* is set substantially equal to an opposedly facing angle θ made by the above-mentioned inclined portions 223*a*.

In the manufacturing device 100 having such a configuration, the manner of operation in a step of connecting the crimp section 23 and the insulated wire 10 to each other by crimp is described.

When the manufacturing process of the crimp-connection structural body 1 starts, as shown in FIG. 6, the conveyance step part 170 conveys the holding insulated wire 10 to the tip end detection step part 110 along a conveyance direction M1, and the conveyance step part 170 moves the insulated wire 10 until the tip end detection step part 110 detects the tip end of the insulated wire 10.

When the tip end detection step part 110 detects the tip end of the insulated wire 10, the conveyance step part 170 conveys the insulated wire 10 to the cover stripping step part 120 along a conveyance direction M2.

When the insulated wire 10 is conveyed to the cover stripping step part 120, the cover stripping step part 120 moves toward the insulated wire 10 fixed by the conveyance step part 170 and, at the same time, sandwiches a portion of the insulated wire 10 at a position away from a tip end of the insulated wire 10 by a predetermined length by cover removing blade dies.

Thereafter, by moving the cover stripping step part 120 in a direction along which the cover stripping step part 120 moves away from the insulated wire 10, the portion of the insulating cover 12 which is sandwiched by the cover removing blade dies is peeled off so that the aluminum core wire 11 is exposed thus forming the core wire exposed portion 13. After the insulating cover 12 is peeled off, the conveyance step part 170 conveys the insulated wire 10 to the marking step part 130 along a conveyance direction M3.

When the insulated wire 10 is conveyed to the marking step part 130, the marking step part 130 detects a position away from the tip end of the core wire exposed portion 13 by a predetermined length in the long length direction X, and forms a mark (not shown) by applying a paint on the insulating cover 12 at such a position. The position away from the core wire exposed portion 13 by the predetermined length is set to a position on the insulating cover 12 which corresponds to an inner rear end of the crimp section 23 when the insulated wire 10 is inserted into the crimp section 23.

When the mark is applied to the insulating cover 12 by painting, the conveyance step part 170 conveys the insulated wire 10 to the inspection step part 140 along a conveyance direction M4.

When the insulated wire 10 is conveyed to the inspection step part 140, the inspection step part 140 images a portion of the insulated wire 10 in the vicinity of the tip end of the insulated wire 10 and acquires an imaged image as image data and, at the same time, detects a peeled-off state of the insulating cover 12, the degree of loosening of the aluminum core wire 11 in the core wire exposed portion 13, or the like based on the acquired image data.

At the time of performing such a detection, when a defect such as a case where the insulating cover 12 is not removed by a desired length occurs, the manufacturing device 100 rejects such an insulated wire 10. On the other hand, when a peeled-off state of the insulating cover 12 is normal, the conveyance step part 170 conveys the insulated wire 10 to the crimp step part 150 along a conveyance direction M5 in accordance with an instruction from the manufacturing device 100.

When the insulated wire 10 is conveyed to the crimp step part 150, the crimp step part 150 conveys the crimp terminal 20 such that the insulated wire 10 and the crimp section 23 opposedly face each other. Thereafter, the conveyance step part 170 moves the insulated wire 10 frontward in a long length direction X only by a predetermined distance thus inserting the insulated wire 10 where the aluminum core wire 11 is exposed into the crimp section 23 from a rear side. In inserting the insulated wire 10 into the crimp section 23, as shown in FIG. 9, an inner diameter of the crimp section 23 is set slightly larger than an outer diameter of the insulated wire 10 so that the insulated wire 10 is loosely inserted into the crimp section 23.

Then, as shown in FIG. 9, the crimp step part 150 caulks the crimp section 23 in an up-and-down direction such that the male die 152 disposed below the crimp section 23 into which the insulated wire 10 is inserted is fitted into the female die 153 disposed above the crimp section 23 thus connecting the insulated wire 10 and the crimp section 23 to each other by crimp.

This will be described in more detail. When the male-and-female die 151 is moved in the up-and-down direction toward the crimp section 23 into which the insulated wire 10 is inserted, for example, as shown in FIG. 10(*a*), the core wire crimp section 23*b* is pressed by the second male side recessed portion 155*b* of the male die 152 and the projecting portion 157*b* of the female die 153 in a sandwiching manner. At this stage of operation, the core wire crimp section 23*b* is sandwiched by lower ends at two positions of the projecting portion 157*b* having an approximately W-shaped cross-sectional shape and an inner end portion of the flat surface portion 155*a* of the male die 152 and hence, rolling of the core wire crimp section 23*b* is restricted.

When the male-and-female die 151 presses the core wire crimp section 23*b*, as shown in FIG. 10(*b*), the core wire crimp section 23*b* is plastically deformed in conformity with a shape of an inner surface of the core wire crimp portion 155 of the male die 152 and a shape of an inner surface of the core wire crimp portion 157 of the female die 153 while a change in an entire width W1 of the core wire crimp section 23*b* is restricted. Further, the core wire crimp section 23*b* is plastically deformed while forming the crimp recessed portion 233 by the projecting portion 157*b* of the female die 153.

When the plastic deformation of the core wire crimp section 23*b* progresses, the core wire exposed portion 13 is pressed by the core wire crimp section 23*b* so that the plastic deformation of the core wire exposed portion 13 starts. At this stage of the operation, the core wire exposed portion 13 is plastically deformed such that the core wire exposed portion 13 enters inner spaces of the projecting portions 235 along inner surfaces of the inclined portions 233*a* and inner surfaces of the pressure-bonded side portion 232.

Thereafter, the male-and-female die 151 plastically deforms the core wire exposed portion 13 and the core wire crimp section 23*b* in a state where a ratio of the crimp height H1 to the entire width W1 is limited to a value which ranges from 1:0.4 to 1:1.1 inclusive and, at the same time, compression ratios of the core wire exposed portion 13 and core wire crimp section 23*b* are limited to values which ranges from 40% to 90% inclusive. At this stage of operation, the male-and-female die 151 plastically deforms the core wire exposed portion 13 and the core wire crimp section 23*b* such that the compression ratio of the core wire exposed portion 13 is set to a value which ranges from 40% to 75% inclusive. In this manner, the core wire exposed portion 13 and the core wire crimp section 23*b* are connected to each other by crimp.

Although the detailed description is omitted, the insulating cover 12 and the cover crimp section 23*a* are plastically deformed in conformity with a shape of an inner surface of the cover crimp portion 154 of the male die 152 and a shape of an inner surface of the cover crimp portion 156 of the female die 156, and are connected to each other by crimp simultaneously with the crimp between the core wire exposed portion 13 and the core wire crimp section 23*b*.

When the crimp terminal 20 and the insulated wire 10 are connected to each other by crimp, as shown in FIG. 6, the conveyance step part 170 conveys the crimp-connection structural body 1 to the inspection step part 140 along a conveyance direction M6.

When the crimp-connection structural body 1 is conveyed to the inspection step part 140, the inspection step part 140 images a portion of the crimp-connection structural body 1 in the vicinity of the crimp section 23 and acquires an imaged image as image data and, at the same time, detects whether a crimp state of the crimp section 23 is defective based on the acquired image data.

For example, when it is recognized based on the image data that a mark is exposed from the crimp section 23, it is determined that the crimp is defective since an insertion length of the insulated wire 10 into the crimp section 23 is short so that the crimp is performed in a state where the core wire exposed portion 13 does not reach the core wire crimp section 23*b*. Alternatively, it is determined whether a crimp state is defective by detecting the entire width W1 or/and the crimp height H1 of the crimp section 23 in a crimp state and also by comparing a detected entire width W1 or/and a detected crimp height H1 with predetermined values respectively.

When a crimp state of the crimp-connection structural body 1 is determined to be normal, the conveyance step part 170 discharges the crimp-connection structural body 1 to a predetermined place from the manufacturing device 100 along a conveyance direction M7 as a completed product. On the other hand, when a crimp state of the crimp-connection structural body 1 is defective, the conveyance step part 170 conveys the crimp-connection structural body 1 to the defective product removing step part 160 along a conveyance direction M8.

When the crimp-connection structural body 1 is conveyed to the defective product removing step part 160, the defective product removing step part 160 moves toward the insulated wire 10 fixed by the conveyance step part 170 and cuts the insulated wire 10 at a position away from the distal end of the crimp-connection structural body 1 by a predetermined length by a cutting blade die thus separating the crimp terminal 20 in a crimp state from the insulated wire 10. Thereafter, the conveyance step part 170 sorts and discharges the insulated wire 10 from which the crimp terminal 20 is cut to a place different from the place where a normal product is discharged along a conveyance direction M9.

In this manner, the insulated wire 10 and the crimp section 23 are caulked by a set of male-and-female die 151 in an up-and-down direction thus manufacturing the crimp-connection structural body 1.

Next, with respect to crimp-connection structural bodies 1 manufactured as described above, the crimp-connection structural bodies which differ from each other with respect to a rate that a predetermined distance W2 accounts for with respect to an entire width W1 (W2/W1), an opposedly facing angle θ, a rate that a depth H2 accounts for with respect to the crimp height H1 (H2/H1), a compression ratio, and a ratio of the crimp height H1 to the entire width W1 (W1:H1) are prepared. These crimp-connection structural bodies are compared with each other with respect to the presence or absence of a gap formed between the core wire crimp section 23*b* and the core wire exposed portion 13 and irregularity in an electric resistance value, and the result of the comparison is shown in Table 1. Further, by reference to FIG. 11, the description is made with respect to difference in electric resistance between the crimp-connection structural bodies which have the same compression ratio but differ from each other in a rate that a predetermined distance W2 accounts for with respect to an entire width W1.

Figure 11:
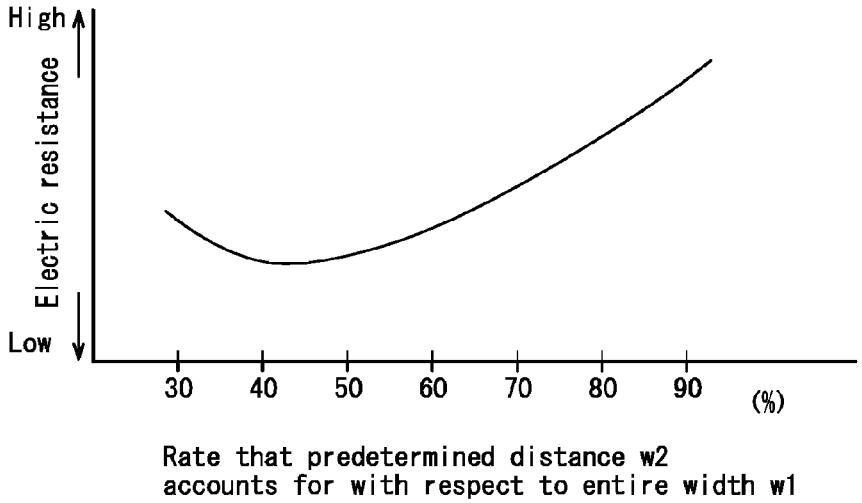
FIG. 11 is an explanatory view for describing a relationship between a rate that a predetermined distance accounts for with respect to an entire width and electric resistance.

FIG. 11 is an explanatory view for describing a relationship between a rate that a predetermined distance W2 accounts for with respect to an entire width W1 and electric resistance.

example 1 and the comparison example 2 with respect to "rate that depth H2 accounts for with respect to crimp height H1" and "ratio of crimp height H1 to entire width W1" in Table 1.

"Cross-sectional area of core wire" in Table 1 indicates a cross-sectional area of the core wire in a crimp state.

Further, with respect to "irregularity in resistance value" in Table 1, "extremely small", "small", "middle" or "large" is given corresponding to the degree of irregularity in an electric resistance value among a plurality of crimp-connection structural bodies having the same configuration measured after a thermal shock test.

Further, with respect to a determination condition of the crimp-connection structural body, a determination of "excellent" is given to a crimp-connection structural body where irregularity in an electric resistance value after a thermal shock test is extremely small, a determination of "good" is given to a crimp-connection structural body where irregularity in an electric resistance value is small and is allowable, a determination of "fair" is given to a crimp-connection structural body where the degree of irregularity in an electric

TABLE 1

Aluminum core wire: 2.5 $mm^2$

| | Shape of recessed portion | | | | | | | | |
|---|---|---|---|---|---|---|---|---|---|
| | W2/W1 (%) | Opposedly facing angle θ (°) | H2/H1 (%) | Compression ratio (%) | W1:H1 | Cross-sectional area of core wire ($mm^2$) | Presence or absence of gap | Irregularity in resistance value | Determination |
| Example 1 | 68.8 | 30 | 48.3 | 50 | 1:0.41 | 1.30 | Absent | Excellent Small | Extremely |
| Example 2 | 68.8 | 30 | 42.4 | 60 | 1:0.46 | 1.54 | Absent | Small | Good |
| Example 3 | 68.8 | 30 | 39.7 | 70 | 1:0.49 | 1.83 | Absent | Large | Bad |
| Example 4 | 70.5 | 60 | 45.8 | 50 | 1:0.41 | 1.27 | Absent | Middle | Fair |
| Example 5 | 70.5 | 60 | 39.1 | 60 | 1:0.48 | 1.52 | Absent | Small | Good |
| Example 6 | 70.5 | 60 | 35.8 | 70 | 1:0.53 | 1.82 | Absent | Large | Bad |
| Example 7 | 73.7 | 90 | 36.7 | 50 | 1:0.45 | 1.29 | Absent | Small | Good |
| Example 8 | 73.7 | 90 | 32.4 | 60 | 1:0.51 | 1.62 | Absent | Small | Good |
| Example 9 | 73.7 | 90 | 30.3 | 70 | 1:0.54 | 1.86 | Absent | Small | Good |
| Example 10 | 77.2 | 120 | 26.5 | 50 | 1:0.48 | 1.37 | Absent | Middle | Fair |
| Example 11 | 77.2 | 120 | 24.2 | 60 | 1:0.52 | 1.60 | Absent | Large | Bad |
| Example 12 | 77.2 | 120 | 22.6 | 70 | 1:0.56 | 1.87 | Absent | Middle | Fair |
| Comparison example 1 | 28.6 | 0 | — | 60 | — | 1.53 | Absent | Extremely Small | Excellent |
| Comparison example 1 | 28.6 | 0 | — | 70 | — | 1.93 | Present | Extremely Small | Bad |

Figure 15:
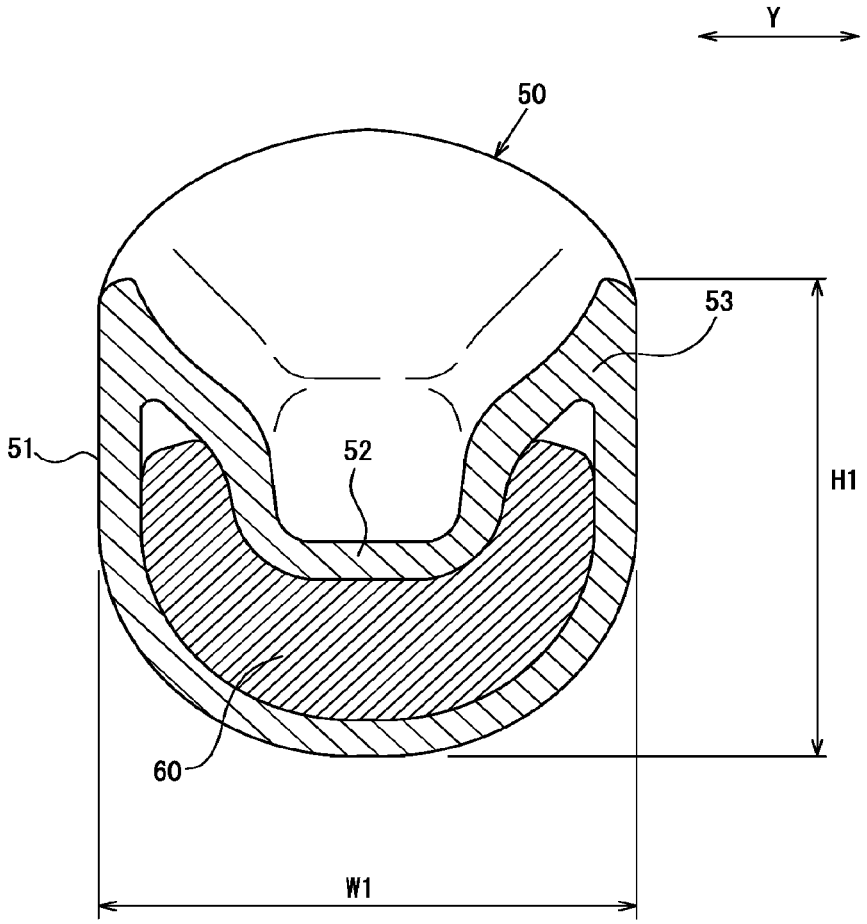
FIG. 15 is a cross-sectional view showing a radial cross section of a conductor crimp section of a conventional crimp-connection structural body.

W2/W1 rate that predetermined distance W2 accounts for with respect to entire width W1
H2/H1 rate that depth H2 accounts for with respect to crimp height H1
W1/H1 ratio of crimp height H1 with respect to entire width W1
—: calculation impossible In Table 1, the examples 1 to 12 indicate the crimp-connection structural bodies 1 each having the crimp recessed portion 233 of the embodiment, and the comparison example 1 and the comparison example 2 indicate conventional crimp-connection structural bodies each having a recessed portion 52 having a desired shape (see FIG. 15). All of crimp-connection structural bodies of the examples 1 to 12 and the comparison example 1 and the comparison example 2 respectively ensure crimp states having no large irregularity in an electric resistance value in a state immediately after crimp.

In the conventional crimp-connection structural bodies of the comparison example 1 and the comparison example 2, a projecting portion 53 (see FIG. 15) is not stably formed so that a stable crimp height H1 cannot be measured. Accordingly, "calculation impossible" is given to the comparison resistance value is approximately middle, and a determination of "bad" is given to a crimp-connection structural body where irregularity in an electric resistance value goes beyond an allowable range. Further, with respect to a crimp-connection structural body where a gap is formed between an inner peripheral surface of the core wire crimp section 23*b* and an outer peripheral surface of the core wire exposed portion 13 in cross section taken along a width direction Y, a favorable connection state cannot be acquired and hence, even when the degree of irregularity in an electric resistance value is "extremely small", a determination "bad" is given by comprehensively determining the crimp-connection structural body.

In Table 1, as compared the crimp-connection structural body of the comparison example 1 where the compression ratio is 60% with the crimp-connection structural body of the comparison example 2 where the compression ratio is 70%, it is understood that even when the crimp-connection structural bodies have substantially the same irregularity in an electric resistance value, a gap is more liable to be formed between the conductor crimp section 51 and the conductor 60 as a compression ratio is increased.

On the other hand, the crimp-connection structural bodies of the example 1 to the example 12 have substantially the same compression ratio as the crimp-connection structural bodies of the comparison example 1 and the comparison example 2. However, a gap is not formed between the core wire crimp section 23*b* and the core wire exposed portion 13 in the crimp-connection structural bodies of the example 1 to the example 12. That is, it is understood that, in the crimp-connection structural bodies of the example 1 to the example 12, a shape of the crimp recessed portion 233 is controlled so that the core wire crimp section 23*b* is plastically deformed while a shape of an inner surface of the core wire crimp section 23*b* being controlled whereby a favorable connection state between the core wire crimp section 23*b* and the core wire exposed portion 13 is ensured.

For example, as compared the crimp-connection structural body of the example 9 with the crimp-connection structural body of the comparison example 2 having the same compression ratio, while a cross-sectional area of a core wire in a crimp state is 1.86 $mm^2$ in the crimp-connection structural body of the example 9, a cross-sectional area of a core wire in a crimp state is 1.93 $mm^2$ in the crimp-connection structural body of the comparison example 2. That is, it is safe to say that a peripheral length of the core wire exposed portion 13 in a crimp state is long in the crimp-connection structural body of the comparison example 2 compared with the crimp-connection structural body of the example 9.

However, although there is no gap formed between the core wire crimp section 23*b* and the core wire exposed portion 13 in the crimp-connection structural body of the example 9, a gap is formed between the conductor crimp section 51 and the conductor 60 in the crimp-connection structural body in the comparison example 2. In view of the above, it is safe to say that the crimp-connection structural body of the example 9 can more easily ensure a contact length stably along which an outer peripheral surface of a core wire and an inner peripheral surface of a conductor crimp section are brought into contact with each other compared to the crimp-connection structural body of the comparison example 2.

Further, it is understood that, in the crimp-connection structural bodies of the example 1 to the example 12, there is a tendency that the smaller an opposedly facing angle θ becomes, the smaller an irregularity in resistance value becomes. In addition to such a tendency, in the crimp-connection structural bodies of the example 1 to the example 12, there is a tendency that the smaller a compression ratio, that is, the smaller a ratio of the crimp height H1 to the entire width W1, the smaller a cross-sectional area of the core wire exposed portion 13, and the smaller the irregularity in the resistance value.

Further, as compared electric resistance between crimp-connection structural bodies which have the same core wire compression ratio of the core wire exposed portion and the same core wire compression ratio of the core wire crimp section but are different in a rate that the predetermined distance W2 accounts for with respect to the entire width W1, as shown in FIG. 11, electric resistance becomes the smallest when the rate that the predetermined distance W2 accounts for with respect to the entire width W1 is approximately 40%. Further, it is understood that as the rate that the predetermined distance W2 accounts for with respect to the entire width W1 is smaller than approximately 40% or larger than approximately 40%, there is a tendency that electric resistance is increased.

In the above-mentioned Table 1, the description is made for the case using the aluminum core wire 11 having a cross-sectional area of 2.5 $mm^2$. For reference, Table 2 shows the presence or absence of a gap between the core wire crimp section 23*b* and the core wire exposed portion 13 and irregularity in an electric resistance value in crimp-connection structural bodies each formed using an aluminum core wire 11 having a cross-sectional area of 0.75 $mm^2$.

TABLE 2

| Aluminum core wire: 0.75 $m^2$ | | | | | | | | | |
|---|---|---|---|---|---|---|---|---|---|
| | Shape of recessed portion | | | | | | | | |
| | W2/W1 (%) | Opposedly facing angle θ (°) | H2/H1 (%) | Compression ratio (%) | W1:H1 | Cross-sectional area of core wire ($mm^2$) | Presence or absence of gap | Irregularity in resistance value | Determination |
| Example 13 | 69.7 | 30 | 30.0 | 50 | 1:0.73 | 0.36 | Absent | Extremely Small | Excellent |
| Example 14 | 69.7 | 30 | 27.7 | 60 | 1:0.79 | 0.42 | Absent | Extremely Small | Excellent |
| Example 15 | 69.7 | 30 | 25.7 | 70 | 1:0.85 | 0.50 | Absent | Extremely Small | Excellent |
| Example 16 | 70.3 | 90 | 17.5 | 50 | 1:0.73 | 0.35 | Absent | Extremely Small | Excellent |
| Example 17 | 70.3 | 90 | 16.1 | 60 | 1:0.79 | 0.42 | Absent | Extremely Small | Excellent |
| Example 18 | 70.3 | 90 | 15.0 | 70 | 1:085 | 0.50 | Absent | Extremely Small | Excellent |

W2/W1 rate that predetermined distance W2 accounts for with respect to entire width W1
H2/H1 rate that depth H2 accounts for with respect to crimp height H1
W1/H1 ratio of crimp height H1 with respect to entire width W1

As shown in Table 2, when the aluminum core wire has a cross-sectional area of 0.75 $mm^2$, in all crimp-connection structural bodies of the example 13 to the example 18, it is understood that there is no gap formed between the core wire crimp section 23*b* and the core wire exposed portion 13 so that irregularity in an electric resistance value is extremely small whereby favorable connection is acquired. In view of the above, it is safe to say that by limiting the predetermined distance W2, the opposedly facing angle θ and the depth H2 in the crimp recessed portion 233, a favorable connection state can be ensured regardless of an outer diameter of the aluminum core wire 11 and an inner diameter and an outer diameter of the core wire crimp section 23*b*.

Next, a connector which mounts the above-mentioned crimp-connection structural body 1 in the inside thereof is described by reference to FIG. 12.

Figure 12:
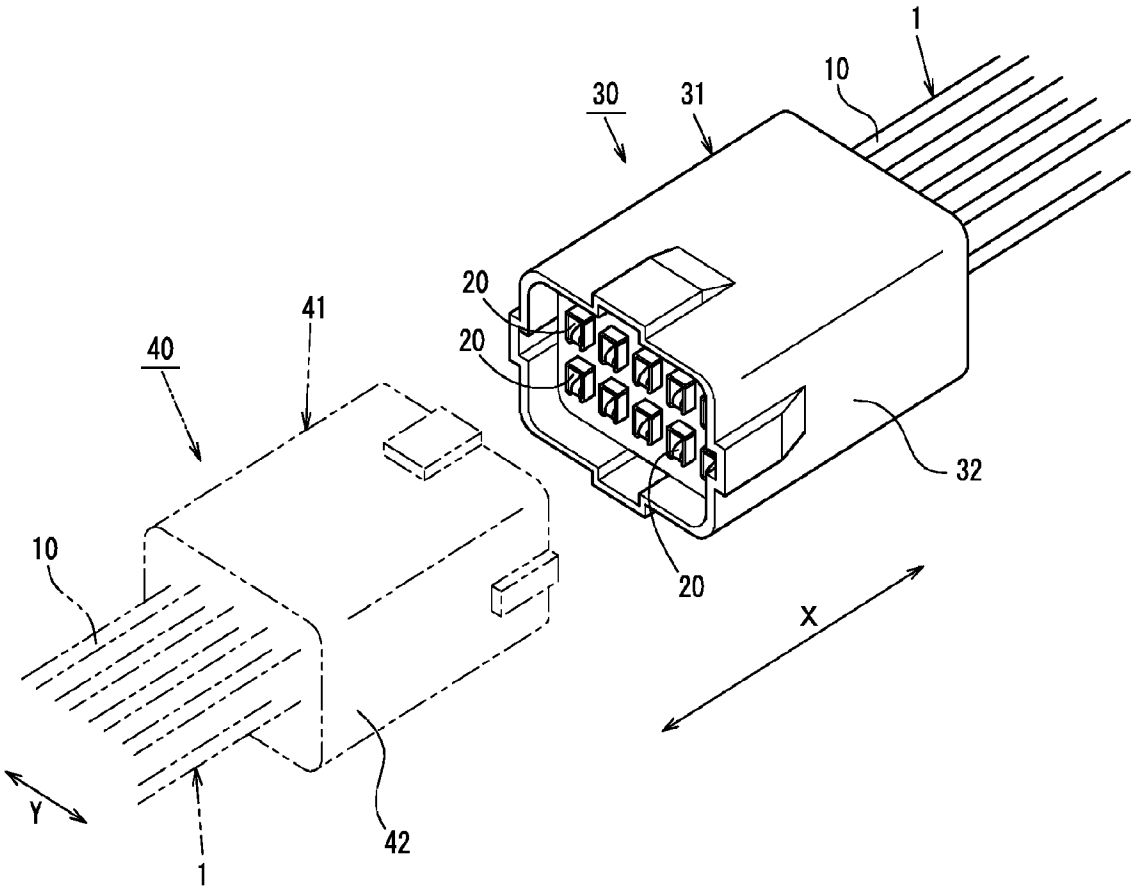
FIG. 12 is an external appearance perspective view of a female connector and a male connector showing a connection correspondence state between these connectors.

FIG. 12 is an external appearance perspective view of a female connector 31 and a male connector 41 showing a connection correspondence state between these connectors. In FIG. 12, the male connector 41 is indicated by a double dotted chain line.

A female connector housing 32 has a plurality of cavities in each of which the crimp terminal 20 is mountable along the long length direction X. The female connector housing 32 is formed into a box shape where a cross-sectional shape of the female connector housing 32 in the width direction Y is an approximately rectangular shape. A wire harness 30 having the female connector 31 is formed by mounting a plurality of crimp-connection structural bodies 1 each of which is formed of the above-mentioned crimp terminal 20 in the inside of such a female connector housing 32 along the long length direction X.

The male connector housing 42 which corresponds to the female connector housing 32 has, in the same manner as the female connector housing 32, a plurality of openings in each of which the crimp terminal is mountable. The male connector housing 42 has an approximately rectangular shape in cross section taken along a width direction Y, and is configured to be connectable to the female connector housing 32 in a concavo-convex relationship.

A wire harness 40 having the male connector 41 is provided by mounting the crimp-connection structural bodies 1 each of which is formed of a male crimp terminal not shown in the inside of such a male connector housing 42 along the long length direction X.

The wire harness 30 and the wire harness 40 are connected to each other by making the female connector 31 and the male connector 41 engage with each other by fitting engagement.

In the crimp-connection structural body 1 which realizes the above-mentioned configuration, stable conductivity can be ensured by controlling a cross-sectional shape of the core wire crimp section 23*b* in a crimp state.

This will be described more specifically. In the crimp-connection structural body 1, at the time of crimp the core wire crimp section 23*b* and the core wire exposed portion 13, by forming the crimp recessed portion 233, it is possible to form the projecting portions 235 projecting outward in a radial direction on the core wire crimp section 23*b* adjacently to both ends of the crimp recessed portion 233.

At the time of forming the core wire crimp section 23*b*, by limiting the predetermined distance W2 to 90% or less of the entire width W1 of the core wire crimp section 23*b*, and also by limiting an opposedly facing angle θ made by the inclined portions 233*a* to a value which ranges from 10° to 120° inclusive, in the crimp-connection structural body 1, it is possible to ensure widths of the projecting portions 235 in an approximately horizontal direction at a predetermined rate with respect to the entire width W1 of the core wire crimp section 23*b*. Accordingly, in the crimp-connection structural body 1, a shape of an inner surface and a wall thickness of the projecting portions 235 can be easily controlled and hence, the electrical connection between the core wire crimp section 23*b* and the core wire exposed portion 13 can be more stably ensured.

Further, by bringing a connection state immediately after the crimp into a more favorable state, for example, even when thermal expansion and thermal contraction are repeatedly generated in the core wire crimp section 23*b* or in the core wire exposed portion 13 as in the case of a thermal shock test, in the crimp-connection structural body 1, the increase and irregularity in electric resistance caused by a change in a connection state can be suppressed. Accordingly, in the crimp-connection structural body 1, the stable electrical connection can be continuously ensured not only immediately after the crimp but also after the crimp.

In other words, when either one of the predetermined distance W2 and the opposedly facing angle θ goes beyond the above-mentioned range, in the crimp-connection structural body 1, a shape of an inner surface which can stably ensure the electrical connection between the core wire crimp section 23*b* and the core wire exposed portion 13 cannot be formed and hence, stable conductivity cannot be ensured.

This will be described in more detail. The smaller the rate that the predetermined distance W2 accounts for with respect to the entire width W1 of the core wire crimp section 23*b* becomes, the wider a width of the projecting portion 235 in an approximately horizontal direction becomes. Accordingly, although a change in wall thickness of the projecting portion 235 of the core wire crimp section 23*b* brought about by the plastic deformation can be made small, an inner peripheral length of the core wire crimp section 23*b* in cross section taken along a width direction Y is liable to become long compared to an outer peripheral length of the core wire exposed portion 13 and hence, there is a possibility that a gap is formed between the core wire crimp section 23*b* and the core wire exposed portion 13.

On the other hand, the larger the rate that the predetermined distance W2 accounts for with respect to the entire width W1 of the core wire crimp section 23*b*, the narrower the width of the projecting portion 235 in an approximately horizontal direction becomes. Accordingly, an inner space which allows the entrance of the core wire exposed portion 13 therein due to crimp is minimally formed in the projecting portion 235. Further, when the rate that the predetermined distance W2 accounts for with respect to the entire width W1 of the core wire crimp section 23*b* is excessively large, the projecting portion 235 which has an acute angle in cross section taken along a width direction Y and partially has a small wall thickness is formed and hence, there is a possibility that a crack occurs in the projecting portion 235.

Accordingly, when the rate that the predetermined distance W2 accounts for with respect to the entire width W1 of the core wire crimp section 23*b* goes beyond the predetermined range, in the crimp-connection structural body 1, a stable contact length cannot be ensured because of the formation of a gap between the core wire crimp section 23*b* and the core wire exposed portion 13.

In view of the above, it is desirable to limit the predetermined distance W2 in the crimp recessed portion 233 to 90% or less of the entire width W1 of the core wire crimp section 23*b*. It is more preferable to limit the predetermined distance W2 in the crimp recessed portion 233 to a value which ranges from 45% to 90% inclusive of the entire width W1 of the core wire crimp section 23*b*. By setting the predetermined distance W2 in the crimp recessed portion 233 in this manner, the more stable contact length can be ensured.

Further, the smaller the opposedly facing angle θ becomes, the higher the tendency that the inclined portion 233*a* is raised approximately upright becomes and hence, a wall thickness of the crimp recessed portion 233 on a proximal end side is liable to be decreased by bending. Accordingly, a crack or the like is liable to occur in a thickness decreased portion of the crimp recessed portion 233 due to thermal expansion, thermal contraction or the like.

Further, at the time of crimp the core wire crimp section 23*b* and the core wire exposed portion 13 to each other, the inclined portions 233*a* are plastically deformed such that the inclined portions 233*a* are raised approximately upright and hence, it becomes difficult for the core wire exposed portion 13 to smoothly enter the inner spaces of the projecting portions 235. Accordingly, in the crimp-connection structural body 1, a contact length between the core wire crimp section 23*b* and the core wire exposed portion 13 cannot be stably ensured.

On the other hand, the larger the opposedly facing angle θ becomes, the more difficult the formation of the projecting portions 235 of the core wire crimp section 23*b* becomes. Accordingly, in the crimp-connection structural body 1, the core wire exposed portion 13 cannot be strongly pressure-bonded by the crimp recessed portion 233 of the core wire crimp section 23*b* and hence, a mechanical strength against a load generated at the time of pulling out the insulated wire 10 from the crimp terminal 20 cannot be ensured, for example. It is necessary to strongly pressure-bond the whole core wire crimp section 23*b* to ensure a mechanical strength. In this case, there is a possibility that the core wire exposed portion 13 is disconnected due to the excessive plastic deformation.

Accordingly, when the opposedly facing angle θ goes beyond the predetermined range, in the crimp-connection structural body 1, the stable electrical connection cannot be ensured.

In view of the above, it is desirable to limit the opposedly facing angle θ made by the inclined portions 233*a* to a value which ranges from 10° to 120° inclusive. It is more preferable to limit the opposedly facing angle θ made by the inclined portions 233*a* to a value which ranges from 30° to 60° inclusive. By limiting the opposedly facing angle θ in this manner, the more stable electrical connection can be ensured.

By limiting the predetermined distance W2 to 90% or less of the entire width W1 of the core wire crimp section 23*b* and by limiting the opposedly facing angle θ made by the inclined portions 233*a* to a value which ranges from 10° to 120° inclusive, in the crimp-connection structural body 1, the depth H2 which is a length of the crimp recessed portion 233 along the center axis C can be optimized by limiting the depth H2 to a value which falls within a predetermined range. By optimizing the depth H2 of the crimp recessed portion 233, in the crimp-connection structural body 1, it is possible to prevent the depth H2 of the crimp recessed portion 233 from becoming excessively large or excessively small thus controlling a shape of the inner surface and a wall thickness of the projecting portions 235 with more certainty.

With such a configuration, in the crimp-connection structural body 1, it is possible to stably ensure a contact length of a contact portion between the inner peripheral surface of the core wire crimp section 23*b* and the outer peripheral surface of the core wire exposed portion 13 by controlling a shape of the inner surface, a wall thickness and the like of the projecting portions 235 regardless of an outer diameter of the core wire crimp section 23*b* and an outer diameter of the aluminum core wire 11.

Accordingly, in the crimp-connection structural body 1, it is possible to stably ensure a contact area between the core wire crimp section 23*b* and the core wire exposed portion 13 in a long length direction of the core wire crimp section 23*b* having an approximately cylindrical shape. In addition, the core wire exposed portion 13 can be strongly pressure-bonded by the crimp recessed portion 233 and hence, in the crimp-connection structural body 1, both the electrical connection and the mechanical strength can be ensured.

Accordingly, in the crimp-connection structural body 1, stable conductivity can be ensured by controlling a cross-sectional shape of the core wire crimp section 23*b* in a crimp state in such a manner that the predetermined distance W2 is limited to 90% or less of the entire width W1 of the core wire crimp section 23*b* and the opposedly facing angle θ made by the inclined portions 233*a* is limited to a value which ranges from 10° to 120° inclusive.

A sum of a cross-sectional area of the core wire exposed portion 13 and a cross-sectional area of the core wire crimp section 23*b* in a crimp state is set to a value which ranges from 40% to 90% inclusive of the sum of the cross-sectional area of the core wire exposed portion 13 and the cross-sectional area of the core wire crimp section 23*b* in a pre-crimp state. Accordingly, in the crimp-connection structural body 1, the electrical connection and the mechanical strength can be more stably ensured.

This will be described more specifically. With respect to a rate of a sum of a cross-sectional area of the core wire exposed portion 13 and a cross-sectional area of the core wire crimp section 23*b* in a crimp state to a sum of the cross-sectional area of the core wire exposed portion 13 and the cross-sectional area of the core wire crimp section 23*b* in a pre-crimp state, that is, a compression ratio, the smaller the compression ratio becomes, in the crimp-connection structural body 1, the more a state is likely to be brought about where the core wire crimp section 23*b* and the core wire exposed portion 13 are pressure-bonded to each other at a more excessively large compression ratio. Accordingly, there is a possibility that strength of the core wire exposed portion 13 of the insulated wire 10 is lowered due to the elongation of the core wire exposed portion 13 caused by crimp so that the core wire exposed portion 13 is disconnected. Further, along with the reduction of a cross-sectional area of the core wire exposed portion 13, there is a possibility that a resistance value of the core wire exposed portion 13 is increased.

On the other hand, with respect to the rate of the sum of the cross-sectional area of the core wire exposed portion 13 and the cross-sectional area of the core wire crimp section 23*b* in a crimp state to the sum of the cross-sectional area of the core wire exposed portion 13 and the cross-sectional area of the core wire crimp section 23*b* in a pre-crimp state, that is, the compression ratio, the larger the compression ratio becomes, in the crimp-connection structural body 1, the smaller a pressure at which the core wire crimp section 23*b* presses the core wire exposed portion 13 becomes. Accordingly, for example, a mechanical strength against a load generated at the time of pulling out the insulated wire 10 from the crimp terminal 20 cannot be ensured. Further, there is a possibility that sufficient connection resistance cannot be acquired.

Accordingly, when a rate of the sum of the cross-sectional area of the core wire exposed portion 13 and the cross-sectional area of the core wire crimp section 23*b* in a crimp state to the sum of the cross-sectional area of the core wire exposed portion 13 and the cross-sectional area of the core wire crimp section 23*b* in a pre-crimp state goes beyond a predetermined range, in the crimp-connection structural body 1, the electrical connection or a mechanical strength cannot be stably ensured.

In view of the above, it is desirable to limit a sum of the cross-sectional area of the core wire exposed portion 13 and the cross-sectional area of the core wire crimp section 23*b* in a crimp state to a value which ranges from 40% to 90% inclusive of the sum of the cross-sectional area of the core wire exposed portion 13 and the cross-sectional area of the core wire crimp section 23*b* in a pre-crimp state. By limiting the cross-sectional area to such a value, in the crimp-connection structural body 1, both the electrical connection and the mechanical strength can be ensured.

Accordingly, in the crimp-connection structural body 1, by limiting the sum of the cross-sectional area of the core wire exposed portion 13 and the cross-sectional area of the core wire crimp section 23*b* in a crimp state to a value which ranges from 40% to 90% inclusive of the sum of the cross-sectional area of the core wire exposed portion 13 and the cross-sectional area of the core wire crimp section 23*b* in a pre-crimp state, both the mechanical strength and the electrical connection can be ensured thus ensuring more stable conductivity.

The depth H2 of the crimp recessed portion 233 is set to a value which ranges from 10% to 50% inclusive of the crimp height H1 of the core wire crimp section 23*b*. Accordingly, in the crimp-connection structural body 1, the electrical connection between the core wire crimp section 23*b* and the core wire exposed portion 13 can be more stably ensured.

This will be described more specifically. The deeper the depth H2 of the crimp recessed portion 233 becomes, the greater the possibility becomes where the core wire exposed portion 13 is disconnected by the deeply formed crimp recessed portion 233 or a wall thickness of the crimp recessed portion 233 formed due to the plastic deformation is decreased so that a crack occurs in the crimp recessed portion 233.

On the other hand, the shallower the depth H2 of the crimp recessed portion 233 becomes, the greater the possibility becomes where the crimp recessed portion 233 cannot strongly pressure-bond the core wire exposed portion 13 so that, in the crimp-connection structural body 1, a mechanical strength between the core wire crimp section 23*b* and the core wire exposed portion 13 cannot be stably ensured. Accordingly, when the depth H2 of the crimp recessed portion 233 goes beyond a predetermined range, in the crimp-connection structural body 1, the electrical connection between the core wire crimp section 23*b* and the core wire exposed portion 13 cannot be stably ensured.

In view of the above, it is desirable to set the depth H2 of the crimp recessed portion 233 to a value which ranges from 10% to 50% inclusive of the crimp height H1. By setting the depth H2 of the crimp recessed portion 233 to such a value, in the crimp-connection structural body 1, the electrical connection between the core wire crimp section 23*b* and the core wire exposed portion 13 can be stably ensured.

Accordingly, in the crimp-connection structural body 1, by limiting the depth H2 of the crimp recessed portion 233 to a value which ranges from 10% to 50% inclusive of the crimp height H1, the electrical connection between the core wire crimp section 23*b* and the core wire exposed portion 13 can be more stably ensured and hence, more stable conductivity can be ensured.

A ratio of the crimp height H1 to the entire width W1 of the core wire crimp section 23*b* is set to a value ranges from 1:0.4 to 1:1.1 inclusive. Accordingly, the crimp-connection structural body 1 can be mounted in a cavity or the like formed in the female connector housing 32 with certainty in a state where an electrical connection is ensured.

This will be described more specifically. By measuring whether or not the crimp height H1 falls within a predetermined range in a post-crimp state, in the crimp-connection structural body 1, it is possible to confirm a crimp state of the core wire crimp section 23*b* without cutting the crimp-connection structural body 1. Accordingly, when the crimp height H1 goes beyond a predetermined range, it is determined that a crimp state of the crimp-connection structural body 1 is defective.

The entire width W1 of the core wire crimp section 23*b* is limited by a shape or a size of a cavity formed in the female connector housing 32 on which the crimp section 23 is mounted, for example. In addition, at the time of connecting the core wire crimp section 23*b* and the core wire exposed portion 13 to each other by crimp, a compression ratio of the core wire exposed portion 13 and the core wire crimp section 23*b* is limited from a viewpoint of ensuring the electrical connection between the core wire exposed portion 13 and the core wire crimp section 23*b*.

In view of the above, the smaller the crimp height H1 becomes with respect to the entire width W1 of the core wire crimp section 23*b*, in the crimp-connection structural body 1, the greater the possibility becomes where the core wire crimp section 23*b* and the core wire exposed portion 13 are excessively compressed so that the core wire exposed portion 13 is disconnected due to the elongation of the core wire exposed portion 13 caused by crimp. On the other hand, the larger the crimp height H1 becomes with respect to the entire width W1 of the core wire crimp section 23*b*, for example, the more a drawback is liable to be generated where the crimp-connection structural body 1 cannot be mounted in the cavity formed in the female connector housing 32.

Accordingly, with respect to the crimp-connection structural body 1 where the core wire exposed portion 13 is strongly pressure-bonded by the crimp recessed portion 233, for example, to mount the crimp-connection structural body 1 in the cavity formed in the female connector housing 32 in a state where more stable conductivity is ensured, it is necessary to optimize the relationship between the entire width W1 of the core wire crimp section 23*b* and the crimp height H1.

Accordingly, it is desirable to limit a ratio of the crimp height H1 to the entire width W1 of the core wire crimp section 23*b* to a value which ranges from 1:0.4 to 1:1.1. Due to the limitation of the ratio, the crimp-connection structural body 1 can ensure the above-mentioned more stable electrical connection, and can be mounted with certainty in the cavity or the like formed in the female connector housing 32.

Accordingly, by limiting a ratio of the crimp height H1 to the entire width W1 of the core wire crimp section 23*b* to a value which ranges from 1:0.4 to 1:1.1, the crimp-connection structural body 1 can be mounted with certainty on the female connector housing 32 or the like while ensuring the more stable conductivity.

Further, the sealing portion 23*c* is provided to the crimp section 23 and hence, in the crimp-connection structural body 1, it is possible to prevent the intrusion of moisture from the opening of the crimp section 23 on a core wire exposed portion 13 side. Accordingly, in the crimp-connection structural body 1, it is possible to prevent the occurrence of a state where the electrical connection between the core wire crimp section 23*b* and the core wire exposed portion 13 cannot be ensured due to corrosion of the core wire exposed portion 13 caused by intruded moisture or the like.

Further, in the crimp-connection structural body 1, by crimp the insulating cover 12 of the insulated wire 10 and the cover crimp section 23*a* to each other, it is possible to easily bring the inside of the crimp section 23 in a crimp state into a sealed state. Accordingly, in the crimp-connection structural body 1, the intrusion of moisture into the inside of the crimp section 23 can be prevented with more certainty.

Accordingly, in the crimp-connection structural body 1, water-blocking performance can be ensured by the sealing portion 23*c* and hence, the more stable conductivity can be ensured.

A core wire of the insulated wire 10 is made of an aluminum alloy, and the crimp section 23 is made of a copper alloy and hence, the crimp-connection structural body 1 can be light-weighted while ensuring stable conductivity compared to a crimp-connection structural body 1 including an insulated wire having a core wire formed of a copper wire.

Further, by ensuring water-blocking performance at both ends of the crimp section 23 in the long length direction X using the above-mentioned sealing portion 23*c* and the cover crimp section 23*a*, so-called galvanic corrosion can be prevented while achieving the reduction of weight compared to a crimp-connection structural body 1 including an insulated wire having a conductor portion made of a copper alloy.

Accordingly, in the crimp-connection structural body 1, stable conductivity can be ensured while achieving the reduction of weight irrespective of a kind of metal which forms a conductor of the insulated wire 10. Further, in the crimp-connection structural body 1, more stable conductivity can be ensured by ensuring water-blocking performance by the sealing portion 23*c* and the cover crimp section 23*a*.

The wire harness 30 includes a plurality of crimp-connection structural bodies 1 where stable conductivity is ensured by controlling a cross-sectional shape of the core wire crimp section 23*b* in a crimp state and hence, it is possible to form the wire harness 30 which ensures favorable conductivity.

In the wire harness 30, the crimp terminals 20 are disposed in the inside of the female connector housing 32. Accordingly, the female connector 31 where favorable conductivity is ensured can be formed using the crimp-connection structural bodies 1 where stable conductivity is ensured by controlling a cross-sectional shape of each core wire crimp section 23*b* in a crimp state.

Further, at the time of connecting the crimp terminals 20 disposed in the connector housing 32 of the female connector 31 and the crimp terminals 20 disposed in the connector housing 42 of the male connector 41 by making the female connector 31 and the male connector 41 engage with each other by fitting engagement, the crimp terminals 20 in the female connector 31 and the crimp terminals 20 in the male connector 41 can be connected to each other while ensuring stable conductivity.

Accordingly, the female connector 31 can ensure a connection state having more reliable conductivity due to the provision of the crimp-connection structural bodies 1 where stable conductivity is ensured.

Further, the lower portion of the pressure-bonded bottom portion 231 of the core wire crimp section 23*b* is formed such that an outer peripheral surface of the lower portion has an approximately flat surface. With such a configuration, it is possible to prevent the crimp-connection structural body 1 from rolling in a width direction Y more effectively compared to a crimp-connection structural body 1 where an outer peripheral surface of a pressure-bonded bottom portion is formed into an approximately arcuate shape. Accordingly, with such a crimp-connection structural body 1, the conveyance of the crimp-connection structural body 1 by the conveyance step part 170 is facilitated.

In the method of manufacturing the crimp-connection structural body 1 where the core wire exposed portion 13 is connected to the core wire crimp section 23*b* by crimp the core wire exposed portion 13 by the core wire crimp section 23*b* and in the manufacturing device 100 of manufacturing the crimp-connection structural body 1, an inserting step and a crimp step are performed as follows in this order. In the inserting step, the core wire exposed portion 13 is inserted into the core wire crimp section 23*b*. In the crimp step, a cross-sectional shape of the core wire crimp section 23*b* in a width direction Y is formed into an approximately recessed cross-sectional shape and the core wire exposed portion 13 and the core wire crimp section 23*b* are pressure-bonded to each other by forming the core wire crimp section 23*b* such that the opposedly facing angle θ made by two inclined portions 233*a* in the crimp recessed portion 233 formed by indenting is set to a value which ranges from 10° to 120° inclusive, two inclined portions 233*a* being inclined from positions of the core wire crimp section 23*b* spaced apart from each other by a distance 90% or less of the entire width W1 of the core wire crimp section 23*b*. Further, in the method of manufacturing the crimp-connection structural body 1 and in the manufacturing device 100 for the crimp-connection structural body 1, a means which performs the above-mentioned steps are provided. Accordingly, the method of manufacturing the crimp-connection structural body 1 and the manufacturing device 100 of the crimp-connection structural body 1 can ensure stable conductivity by controlling a cross-sectional shape of the core wire crimp section 23*b* in a crimp state.

This will be described more specifically. The crimp recessed portion 233 is formed by limiting the predetermined distance W2 to 90% or less of the entire width W1 of the core wire crimp section 23*b* and by limiting the opposedly facing angle θ made by the inclined portions 233*a* to a value which ranges from 10° to 120° inclusive. Due to such a configuration, according to the method of manufacturing the crimp-connection structural body 1 and the manufacturing device 100 for the crimp-connection structural body 1, at the time of forming the projecting portions 235 on the core wire crimp section 23*b* adjacently to both ends of the crimp recessed portion 233, it is possible to form the projecting portions 235 where a width is ensured at a predetermined rate with respect to the entire width W1 of the core wire crimp section 23*b*.

Accordingly, in the method of manufacturing the crimp-connection structural body 1 and the manufacturing device 100 for the crimp-connection structural body 1, a shape of an inner surface and a wall thickness of the projecting portions 235 can be more easily controlled and hence, a contact length between an inner peripheral surface of the core wire crimp section 23*b* and an outer peripheral surface of the core wire exposed portion 13 can be more stably ensured.

Accordingly, in the method of manufacturing the crimp-connection structural body 1 and the manufacturing device 100 for the crimp-connection structural body 1, stable conductivity can be ensured by controlling a cross-sectional shape of the core wire crimp section 23*b* in a crimp state in such a manner that the crimp recessed portion 233 is formed by limiting the predetermined distance W2 to 90% or less of the entire width W1 of the core wire crimp section 23*b* and by limiting the opposedly facing angle θ made by the inclined portions 233*a* to a value which ranges from 10° to 120° inclusive.

In the above-mentioned embodiment, the core wire of the insulated wire 10 is made of an aluminum alloy. However, a material for forming the core wire of the insulated wire 10 is not limited to an aluminum alloy, and may be made of a copper alloy such as brass. In this case, a sum of a cross-sectional area of the core wire exposed portion 13 and a cross-sectional area of the core wire crimp section 23*b* in a crimp state is set to a value which ranges from 40% to 90% inclusive of the sum of the cross-sectional area of the core wire exposed portion 13 and the cross-sectional area of the core wire crimp section 23*b* in a pre-crimp state. In setting the cross-sectional area of the core wire exposed portion 13 and the cross-sectional area of the core wire crimp section 23*b*, it is desirable to limit the cross-sectional area of the core wire exposed portion 13 in a crimp state to a value which ranges from 40% to 85% inclusive of the cross-sectional area of the core wire exposed portion 13 in a pre-crimp state.

In this embodiment, the crimp terminal 20 is made of a copper alloy such as brass. However, a material for forming the crimp terminal 20 is not limited to a copper alloy, and the crimp terminal 20 may be made of an aluminum alloy or the like.

In this embodiment, a female-type crimp terminal is used as the crimp terminal 20. However, the crimp terminal 20 is not limited to such a female-type crimp terminal, and a male-type crimp terminal which engages with a female-type crimp terminal by fitting engagement in a long length direction X may be used as the crimp terminal 20. Alternatively, instead of the box portion 21, the crimp terminal 20 may have an approximately U-shape or annular plate shape.

In this embodiment, the crimp section 23 is formed such that a copper alloy strip blanked into a terminal shape is rounded, and edge portions 23*e*, 23*f* of the blanked copper alloy strip are made to abut against each other and are welded together. However, the crimp section 23 is not limited to the above-mentioned crimp section, and may be a crimp section having a closed cross-sectional shape by integrally welding the edge portions 23*e*, 23*f* which are made to overlap with each other.

In this embodiment, the crimp section 23 is formed such that the cover crimp section 23*a* and the core wire crimp section 23*b* have substantially the same diameter. However, the crimp section 23 is not limited to such a crimp section and, provided that the crimp section 23 is formed using a closed-barrel-type crimp section, the cover crimp section 23*a* and the core wire crimp section 23*b* may have different inner diameters and different outer diameters.

In this embodiment, the sealing portion 23*c* is formed on the distal end of the crimp section 23 on an aluminum core wire 11 side. However, the present invention is not limited to such a configuration, and the front end of the crimp section 23 may be sealed by a member provided separate from the crimp section 23. Alternatively, the sealing portion 23*c* may not be formed on the crimp section 23, and the crimp section 23 may have an open front end.

Further, to enhance water-blocking performance between the cover crimp section 23*a* of the crimp section 23 and the insulating cover 12, the crimp section 23 may be sealed by a member provided separate from the crimp section 23, or a strongly crimp portion may be formed on the cover crimp section 23*a* by indenting the cover crimp section 23*a* inwardly in a radial direction and continuously in a circumferential direction.

In this embodiment, a cross-sectional area of the aluminum core wire 11 is set to 2.5 $mm^2$. However, the cross-sectional area of the aluminum core wire 11 is not limited to such a value, and an aluminum core wire 11 having a suitable cross-sectional area and a suitable outer diameter, and a crimp section 23 having a suitable inner diameter and a suitable outer diameter which correspond to the aluminum core wire 11 having the suitable cross-sectional area and the suitable outer diameter may be used.

In this embodiment, the wire harness 30 is formed by binding a plurality of crimp-connection structural bodies 1. However, the wire harness 30 is not limited to such a configuration, and may be configured such that one crimp-connection structural body 1 is mounted on a single pole connector housing.

In this embodiment, the crimp recessed portion 233 is formed into an approximately W-shape in cross section. However, a cross-sectional shape of the crimp recessed portion 233 may be, for example, formed into an inverted trapezoidal shape, a V shape, a U shape or a shape formed by inclined portions 233*a* having different inclination angles with respect to the center axis C.

Figure 13A:
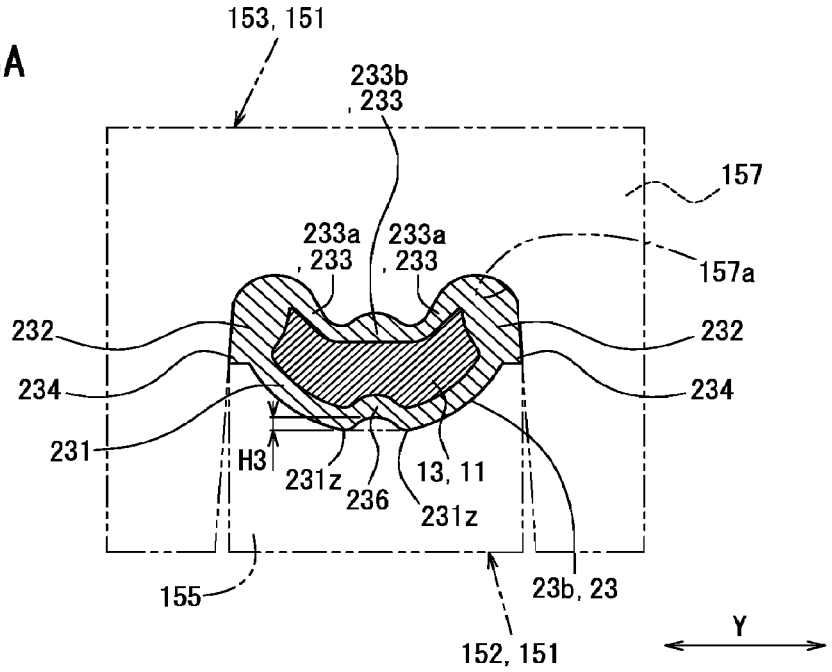
FIG. 13A and FIG. 13B are explanatory views each describing a cross section of another crimp-connection structural body as viewed in a direction indicated by arrows A-A.

As shown in FIG. 13A which describes a cross section of another crimp-connection structural body 1 as viewed in a direction indicated by arrows A-A in FIG. 1, in a crimp state, an inner surface projecting portion 236 which projects at least an inner surface of a core wire crimp section 23*b* inward in a radial direction may be formed on a core wire crimp section 23*b* at a position on a side opposite to a crimp recessed portion 233 in the radial direction. In FIG. 13A, a male-and-female die 151 is indicated by a double dotted chain line.

Assume that the inner surface projecting portion 236 is formed by a projection formed on a bottom surface of a second male side recessed portion 155*b* of a male die 152 in a raised manner simultaneously with the formation of the crimp recessed portion 233 at the time of crimp the core wire exposed portion 13 and the core wire crimp section 23*b* to each other.

In addition, the inner surface projecting portion 236 is formed such that a sum of a depth H2 of the crimp recessed portion 233 and a pressing length H3 is limited to a value which ranges from 10% to 75% inclusive of a crimp height H1, preferably to a value which ranges from 15% to 60% inclusive of a crimp height H1, and more preferably to a value which ranges from 15% to 50% inclusive of the crimp height H1.

For example, assuming a case where a crimp height H1 is 1.45 mm when crimp is performed in a state where an opposedly facing angle θ is set to 60° and a compression ratio of the core wire exposed portion 13 is set to 50%, the crimp is performed such that a depth H2 becomes 0.4 mm and a pressing length H3 becomes 0.31 mm. In other words, the pressing length H3 becomes 21% of the crimp height H1, and a sum of the depth H2 and the pressing length H3 becomes 49% of the crimp height H1. In this case, when a load is released from the crimp section 23 by removing the male-and-female die 151 from the crimp section 23, an average pressure of an inner surface of the crimp section 23 is 10 MPa.

Alternatively, assuming a case where a crimp height H1 is 1.67 mm when crimp is performed in a state where an opposedly facing angle θ is set to 45° and a compression ratio of the core wire exposed portion 13 is set to 61%, the crimp is performed such that a depth H2 becomes 0.6 mm and a pressing length H3 becomes 0.21 mm. In other words, the pressing length H3 becomes 13% of the crimp height H1, and a sum of the depth H2 and the pressing length H3 becomes 49% of the crimp height H1. In this case, when a load is released from the crimp section 23 by removing the male-and-female die 151 from the crimp section 23, an average pressure of an inner surface of the crimp section 23 is 12.5 MPa.

Alternatively, assuming a case where a crimp height H1 is 1.87 mm when crimp is performed in a state where an opposedly facing angle θ is set to 60° and a compression ratio of the core wire exposed portion 13 is set to 71%, the crimp is performed such that a depth H2 becomes 0.6 mm and a pressing length H3 becomes 0.06 mm. In other words, the pressing length H3 becomes 3% of the crimp height H1, and a sum of the depth H2 and the pressing length H3 becomes 35% of the crimp height H1. In this case, when a load is released from the crimp section 23 by removing the male-and-female die 151 from the crimp section 23, an average pressure of an inner surface of the crimp section 23 is 12.5 MPa.

On the other hand, in a case where a pressing length H3 is 0 mm, when a load is released from the crimp section 23 by removing the male-and-female die 151 from the crimp section 23, an average pressure of an inner surface of the crimp section 23 is 5 MPa or less. That is, it is safe to say that, in a post-crimp state, the core wire exposed portion 13 and the inner surface of the core wire crimp section 23*b* are sufficiently brought into contact with each other.

With such a configuration, in the crimp-connection structural body 1, the core wire exposed portion 13 can be sandwiched between the crimp recessed portion 233 and the inner surface projecting portion 236 of the core wire crimp section 23*b*. Accordingly, in the crimp-connection structural body 1, a mechanical strength and electrical connection property between the core wire crimp section 23*b* and the core wire exposed portion 13 can be further enhanced.

Further, by forming the inner surface projecting portion 236 on the core wire crimp section 23*b*, an inner peripheral length of the core wire crimp section 23*b* in cross section taken along a width direction Y is elongated. In addition, a shape of the inner surface and a wall thickness of the projecting portions 235 of the core wire crimp section 23*b* are controlled and hence, in the crimp-connection structural body 1, even when the inner surface projecting portion 236 is formed on the core wire crimp section 23*b*, the core wire exposed portion 13 can enter inner spaces of the projecting portions 235 so that a contact length between the core wire exposed portion 13 and the core wire crimp section 23*b* can be elongated.

In addition, by controlling a sum of the depth H2 of the crimp recessed portion 233 and the pressing length H3 to a value which ranges from 10% to 75% inclusive of the crimp height H1, in the core wire crimp section 23*b* in a post-crimp state, the core wire exposed portion 13 can be sandwiched with certainty by the projecting portion 235 and the inner surface projecting portion 236 while allowing the entrance of the core wire exposed portion 13 into the projecting portions 235. In this case, the larger the pressing length H3 becomes, the more effectively the increase of a resistance ratio after a heat resistance test can be suppressed.

With such a configuration, in the crimp-connection structural body 1, a mechanical strength between the core wire crimp section 23*b* and the core wire exposed portion 13 can be enhanced and, at the same time, the electrical connection can be stably ensured.

Accordingly, in the crimp-connection structural body 1, due to the provision of the inner surface projecting portion 236 which is disposed on a side oppose to the crimp recessed portion 233, more stable conductivity can be ensured.

Figure 13B:
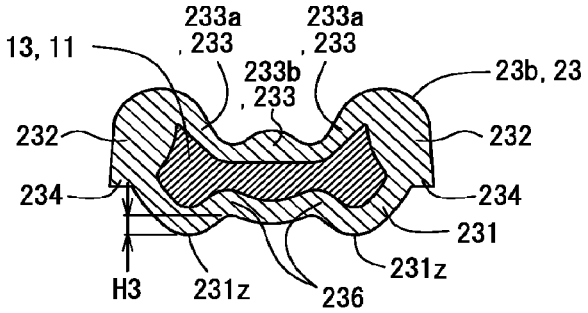

In this embodiment, one inner surface projecting portion 236 is formed on the core wire crimp section 23*b*. However, the number of the inner surface projecting portions 236 is not limited to one. As shown in FIG. 13B, two inner surface projecting portions 236 may be formed on the core wire crimp section 23*b*. With such a configuration, in the crimp-connection structural body 1, a mechanical strength between the core wire crimp section 23*b* and the core wire exposed portion 13 can be further enhanced and, at the same time, the electrical connection between the core wire crimp section 23*b* and the core wire exposed portion 13 can be more stably ensured.

In FIG. 13A and FIG. 13B, the inner surface projecting portion 236 is formed into a shape different from a shape of the crimp recessed portion 233. However, the shape of the inner surface projecting portions 236 is not limited to such a shape. For example, in a cross section taken along a width direction Y, the inner surface projecting portion 236 may have a shape substantially equal to a shape of the crimp recessed portion 233, a shape where only an inner surface portion is raised inward in the radial direction, or the like.

Figure 14:
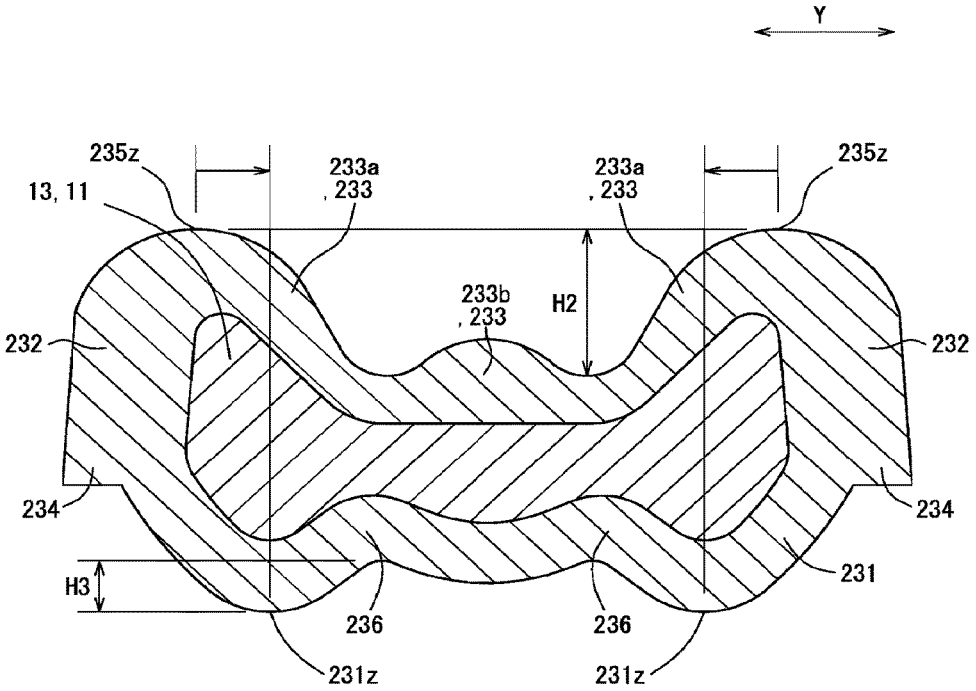
FIG. 14 is an explanatory view describing a cross section of another crimp-connection structural body as viewed in a direction indicated by arrows A-A.

As shown in FIG. 14 which describes a cross section of another crimp-connection structural body as viewed in a direction indicated by arrows A-A, it is desirable to set a radius of an outer surface of the projecting portion 235 such that a value obtained by subtracting a plate thickness of the projecting portion 235 from the radius of the outer surface of the projecting portion 235 is smaller than an outer diameter of the aluminum raw wire 11*a* forming the aluminum core wire 11 and larger than a plate thickness of the core wire crimp section 23*b*.

With such a configuration, the aluminum raw wire 11*a* can easily enter the projecting portion 235 with more certainty. Accordingly, the aluminum raw wires 11*a* are pressure-bonded to the core wire crimp section 23*b* uniformly in cross section of the core wire crimp section 23*b* and hence, favorable electrical connection property can be ensured.

Further, it is desirable to perform the crimp such that, in radial cross section of the core wire crimp section 23*b* in a crimp state, upper end portions 235*z*, 235*z* of the projecting portion 235 are positioned inside lower end portions 231*z*, 231*z* of the pressure-bonded bottom portion 231 in an approximately horizontal direction.

With such a configuration, the core wire exposed portion 13 can be firmly compressed by the core wire crimp section 23*b* and hence, favorable electrical connection property can be ensured.

The crimp step includes a step of forming the inner surface projecting portion 236 and the crimp recessed portion 233 simultaneously, and the crimp means includes a means by which the above-mentioned step is performed. With such a configuration, in the method of manufacturing the crimp-connection structural body 1 and in the manufacturing device 100 for the crimp-connection structural body 1, the crimp recessed portion 233 and the inner surface projecting portion 236 which sandwich the core wire exposed portion 13 can be efficiently formed on the core wire crimp section 23*b*. Accordingly, in the method of manufacturing the crimp-connection structural body 1 and the manufacturing device 100 for the crimp-connection structural body 1, a mechanical strength between the core wire crimp section 23*b* and the core wire exposed portion 13 can be further enhanced and, at the same time, the core wire crimp section 23*b* and the core wire exposed portion 13 can be efficiently connected to each other by crimp.

Further, an inner peripheral length of the core wire crimp section 23*b* in cross section in a radial direction can be elongated, and a shape of an inner surface and a wall thickness of the projecting portions 235 of the core wire crimp section 23*b* can be easily controlled. Accordingly, in the method of manufacturing the crimp-connection structural body 1 and the manufacturing device 100 of the crimp-connection structural body 1, the core wire exposed portion 13 can be made to enter the inner spaces of the core wire crimp section 23*b* without a gap and hence, the core wire crimp section 23*b* and the core wire exposed portion 13 can be connected to each other by crimp.

With such a configuration, in the method of manufacturing the crimp-connection structural body 1 and the manufacturing device 100 for the crimp-connection structural body 1, it is possible to manufacture the crimp-connection structural body 1 where a mechanical strength between the core wire crimp section 23*b* and the core wire exposed portion 13 can be enhanced and, at the same time, the electrical connection can be stably ensured.

Accordingly, in the method of manufacturing the crimp-connection structural body 1 and the manufacturing device 100 for the crimp-connection structural body 1, it is possible to manufacture the crimp-connection structural body 1 where more stable conductivity can be ensured by forming the crimp recessed portion 233 and the inner surface projecting portion 236 simultaneously.

With respect to the correspondence between the configuration in the present invention and the configuration in the above-mentioned embodiment, the conductor in the present invention corresponds to the aluminum core wire 11 in this embodiment. In the same manner, the conductor exposed portion in the present invention corresponds to the core wire exposed portion 13 in this embodiment, the crimp section in the present invention corresponds to the core wire crimp section 23*b* in this embodiment, the inserting means in the present invention corresponds to the conveyance step part 170 in this embodiment, and the crimp means in the present invention corresponds to the crimp step part 150 and the male-and-female die 151 in the embodiment. However, the present invention is not limited to the configuration described in the above-mentioned embodiment, and can be carried out in various modes.

DESCRIPTION OF REFERENCE SIGNS

1: crimp-connection structural body
10: insulated wire
11: aluminum core wire
12: insulating cover
13: core wire exposed portion
20: crimp terminal
23*b*: core wire crimp section
23*c*: sealing portion
30: wire harness
31: female connector
32: female connector housing
40: wire harness
41: male connector
42: male connector housing
100: manufacturing device
150: crimp step part
151: male-and-female dies
170: conveyance step part
233: crimp recessed portion
233*a*: inclined portion
236: inner surface projecting portion
C: center axis
H1: crimp height
H2: depth
W1: entire width
W2: predetermined distance
X: long length direction
θ: opposedly facing angle

The invention claimed is:

1. A crimp-connection structural body comprising:

an insulated wire formed by covering a conductive conductor by an insulating cover having insulation property; and a crimp terminal having a crimp section which allows connection by crimp of a conductor exposed portion formed by exposing the conductor by removing at least a portion of the insulating cover in a vicinity of a distal end of the insulating cover to the crimp section, wherein the conductor exposed portion is connected to the crimp section by the crimp of the conductor exposed portion by the crimp section, wherein the conductor is an aluminum-based conductor including a conductor cross-sectional area of 0.75 $mm^2$ or more and 2.5 $mm^2$ or less, the crimp section is formed of an approximately cylindrical closed-barrel-type crimp section which allows insertion of at least the conductor exposed portion thereinto and extends in a long length direction of the insulated wire, in a crimp state, a cross-sectional shape of the crimp section in a radial direction is formed into an approximately recessed cross-sectional shape having a crimp recessed portion formed by indenting by two inclined portions inclined inward from positions spaced-apart from each other by a predetermined distance in an approximately horizontal direction, the predetermined distance is set to 68.8% or more and 73.7% or less of an entire width of the crimp section in the approximately horizontal direction, an opposedly facing angle made by the inclined portions which opposedly face each other in the radial direction is set to a value which ranges from 30° to 90° inclusive, and in a radial cross section, a sum of a cross-sectional area of the conductor exposed portion and a cross-sectional area of the crimp section in the crimp state is 50% or more and 60% or less of the sum of the cross-sectional area of the conductor exposed portion and the cross-sectional area of the crimp section in a pre-crimp state.

2. The crimp-connection structural body according to claim 1, wherein the crimp recessed portion includes a raised bottom portion formed between the two inclined portions in the radial cross section of the crimp section in the crimp state.

3. The crimp-connection structural body according to claim 1, wherein a depth which is a length of the crimp recessed portion along a center axis in an approximately vertical direction which passes a center of the crimp section in the radial direction is set to a value which ranges from 10% to 50% inclusive of a crimp height of the crimp section.

4. The crimp connection structural body according to claim 1, wherein a ratio of a crimp height of the crimp section to the entire width of the crimp section is set to a value which ranges from 1:0.4 to 1:1.1 inclusive.

5. The crimp-connection structural body according to claim 1, wherein an inner surface projecting portion which is formed by projecting at least an inner surface of the crimp section inward in the radial direction is provided to the crimp section at a position on a side opposite to the crimp recessed portion in the radial direction in the crimp state.

6. The crimp-connection structural body according to claim 1, wherein a sealing portion which extends in the long length direction and seals a distal end of the crimp section in the long length direction is provided to the distal end of the crimp section on a conductor exposed portion side.

7. The crimp-connection structural body according to claim 1, wherein at least the crimp section is made of a copper-based material.

8. A wire harness comprising a plurality of crimp-connection structural bodies each of which is according to claim 1.

9. A method of manufacturing a crimp-connection structural body including: an insulated wire formed by covering a conductive conductor by an insulating cover having an insulation property; and a crimp terminal having a crimp section which allows connection by crimp of a conductor exposed portion formed by exposing the conductor by removing at least a portion of the insulating cover in a vicinity of a distal end of the insulating cover to the crimp section, wherein the conductor exposed portion is connected to the crimp section by the crimp of the conductor exposed portion by the crimp section, wherein the method comprises and sequentially performs:

inserting at least the conductor exposed portion into a closed-barrel-type crimp section having an approximately cylindrical shape and extending in a long length direction of the insulated wire; and forming a cross-sectional shape of the crimp section in a radial direction into an approximately recessed cross-sectional shape and crimping the conductor exposed portion and the crimp section to each other such that a crimp recessed portion having two inclined portions inclined inward from positions of the crimp section spaced apart from each other by a distance which is 68.8% or more and 73.7% or less of an entire width of the crimp section in an approximately horizontal direction is formed by indenting the crimp section while setting an opposedly facing angle made by the two inclined portions of the crimp recessed portion to a value which ranges from 30° to 90° inclusive.

10. The method of manufacturing a crimp-connection structural body according to claim 9, wherein in the forming the cross-sectional shape of the crimp section, an inner surface projecting portion is formed by projecting at least an inner surface of the crimp section inward in the radial direction at a position of the crimp section on a side opposite to the crimp recessed portion in the radial direction, and the inner surface projecting portion and the crimp recessed portion are formed simultaneously.

11. The method of manufacturing a crimp-connection structural body according to claim 9, wherein the conductor is an aluminum-based conductor including a conductor cross-sectional area of 0.75 $mm^2$ or more and 2.5 $mm^2$ or less.

12. The method of manufacturing a crimp-connection structural body according to claim 9, wherein the forming the cross-sectional shape of the crimp section includes forming the cross-sectional shape of the crimp section so that in a radial cross section, a sum of a cross-sectional area of the conductor exposed portion and a cross-sectional area of the crimp section in a crimp state is 50% or more and 60% or less of the sum of the cross-sectional area of the conductor exposed portion and the cross-sectional area of the crimp section in a pre-crimp state.

13. The method of manufacturing a crimp-connection structural body according to claim 9, wherein the forming the cross-sectional shape of the crimp section includes forming the cross-sectional shape of the crimp section so that the crimp recessed portion includes a raised bottom portion formed between the two inclined portions in the radial cross section of the crimp section in the crimp state.

14. A device of manufacturing a crimp-connection structural body including: an insulated wire formed by covering a conductive conductor by an insulating cover having an insulation property; and a crimp terminal having a crimp section which allows connection by crimp of a conductor exposed portion formed by exposing the conductor by removing at least a portion of the insulating cover in a vicinity of a distal end of the insulating cover to the crimp section, wherein the conductor exposed portion is connected to the crimp section by the crimp of the conductor exposed portion by the crimp section, the device comprising:

an inserting device which inserts at least the conductor exposed portion into a closed-barrel-type crimp section having an approximately cylindrical shape and extending in a long length direction of the insulated wire; and a crimp device which forms a cross-sectional shape of the crimp section in a radial direction into an approximately recessed cross-sectional shape and crimps the conductor exposed portion and the crimp section to each other by forming the crimp section such that a crimp recessed portion having two inclined portions inclined inward from positions of the crimp section spaced apart from each other by a distance which is 68.8% or more and 73.7% or less of an entire width of the crimp section in an approximately horizontal direction is formed by indenting the crimp section while setting an opposedly facing angle made by the two inclined portions of the crimp recessed portion to a value which ranges from 30° to 90° inclusive.

15. The device of manufacturing a crimp-connection structural body according to claim 14, wherein the crimp device includes a mechanism which forms an inner surface projecting portion by projecting at least an inner surface of the crimp section inward in the radial direction at a position of the crimp section on a side opposite to the crimp recessed portion in the radial direction, and forms the inner surface projecting portion and the crimp recessed portion simultaneously.

16. The device of manufacturing a crimp-connection structural body according to claim 14, wherein the conductor is an aluminum-based conductor including a conductor cross-sectional area of 0.75 $mm^2$ or more and 2.5 $mm^2$ or less.

17. The device of manufacturing a crimp-connection structural body according to claim 14, wherein the crimp device forms the cross-sectional shape of the crimp section so that in a radial cross section, a sum of a cross-sectional area of the conductor exposed portion and a cross-sectional area of the crimp section in crimp state is 50% or more and 60% or less of the sum of the cross-sectional area of the conductor exposed portion and the cross-sectional area of the crimp section in a pre-crimp state.

18. The device of manufacturing a crimp-connection structural body according to claim 14, wherein the crimp device forms the cross-sectional shape of the crimp section so that the crimp recessed portion includes a raised bottom portion formed between the two inclined portions in the radial cross section of the crimp section in the crimp state.

* * * * *